US007365695B2

(12) United States Patent
Thomas et al.

(10) Patent No.: US 7,365,695 B2
(45) Date of Patent: Apr. 29, 2008

(54) ANTENNA SYSTEM

(75) Inventors: Louis David Thomas, Malvern (GB); Philip Edward Haskell, Gosport (GB); Duncan Alan Wynn, Malvern (GB)

(73) Assignee: Quintel Technology Limited (GB)

( * ) Notice: Subject to any disclaimer, the term of this patent is extended or adjusted under 35 U.S.C. 154(b) by 0 days.

(21) Appl. No.: 10/492,248

(22) PCT Filed: Sep. 12, 2002

(86) PCT No.: PCT/GB02/04166

§ 371 (c)(1),
(2), (4) Date: Apr. 9, 2004

(87) PCT Pub. No.: WO03/036756

PCT Pub. Date: May 1, 2003

(65) Prior Publication Data

US 2004/0209572 A1 Oct. 21, 2004

(30) Foreign Application Priority Data

Oct. 22, 2001 (GB) ..... 0125349.1

(51) Int. Cl.
*H01Q 3/00* (2006.01)
*H01Q 1/50* (2006.01)

(52) U.S. Cl. ..... 343/757; 343/850; 342/373

(58) Field of Classification Search ..... 343/757, 343/824, 822, 850, 869, 729, 725, 793, 878, 343/879, 880, 893, 908, 825; 342/373, 374, 342/375, 368

See application file for complete search history.

(56) References Cited

U.S. PATENT DOCUMENTS 2,041,600 A 5/1936 Frils ..... 250/11

(Continued)

FOREIGN PATENT DOCUMENTS

AU 38746/93 7/1993

(Continued)

OTHER PUBLICATIONS

Hansen, "Phased Array Antennas", *Wiley Series in Microwave and Optical Engineeing*, pp. 188-189 and 195-198 (1988).

(Continued)

*Primary Examiner*—Don Wong
*Assistant Examiner*—Marie Antoinette Cabucos
(74) *Attorney, Agent, or Firm*—McDonnell Boehnen Hulbert & Berghoff LLP

(57) ABSTRACT

An antenna system for sharing of operation employs contiguous transmit frequencies. Transmit frequencies are separated into non-contiguous sub-groups isolated from one another by filters 158(+) and 160(−) associated with positive and negative polarisation. Received frequencies are filtered and split into five signals for input to base station receive ports. Non-contiguous transmit frequency sub-groups are combined by a quadrature hybrid 110 and pass with 90 degree relative phase shift to mutually orthogonal antenna stack ports P(+) and P(−) associated with orthogonally polarised sets of antenna elements AS(+) and AS(−): the ports P(+) and P(−) are isolated from one another by the hybrid 110. The 90 degree phase shift results in one transmit subgroup being radiated with left hand circular polarisation and the other transmit subgroup being radiated with right hand circular polarisation. Changing the relative phase shift changes the radiated polarisation to linear or elliptical, and signal amplitude weighting provides control of antenna beam polarisation direction.

36 Claims, 13 Drawing Sheets

U.S. PATENT DOCUMENTS

| | | | | | |
|---|---|---|---|---|---|
| 2,239,775 | A | | 4/1941 | Bruce | 250/11 |
| 2,245,660 | A | | 6/1941 | Feldman et al. | 250/11 |
| 2,247,666 | A | | 7/1941 | Potter | 250/11 |
| 2,961,620 | A | | 11/1960 | Sommers | 333/31 |
| 3,277,481 | A | | 10/1966 | Robin et al. | 343/100 |
| 3,522,558 | A | | 8/1970 | Stafford et al. | 333/31 |
| 4,241,352 | A | | 12/1980 | Alspaugh et al. | 343/700 MS |
| 4,249,181 | A | | 2/1981 | Lee | 343/100 CS |
| 4,788,515 | A | | 11/1988 | Wong et al. | 333/160 |
| 4,881,082 | A | | 11/1989 | Graziano | 342/432 |
| 4,882,588 | A | * | 11/1989 | Renshaw et al. | 342/373 |
| 5,281,974 | A | | 1/1994 | Kuramoto et al. | 343/700 MS |
| 5,440,318 | A | * | 8/1995 | Butland et al. | 343/814 |
| 5,691,987 | A | | 11/1997 | Friederichs | 370/488 |
| 5,798,675 | A | * | 8/1998 | Drach | 333/161 |
| 5,825,762 | A | | 10/1998 | Kamin et al. | 370/335 |
| 5,905,462 | A | * | 5/1999 | Hampel et al. | 342/372 |
| 5,917,455 | A | * | 6/1999 | Huynh et al. | 343/792.5 |
| 6,016,123 | A | | 1/2000 | Barton et al. | 342/373 |
| 6,067,054 | A | * | 5/2000 | Johannisson et al. | 343/816 |
| 6,094,166 | A | * | 7/2000 | Martek et al. | 342/374 |
| 6,097,267 | A | | 8/2000 | Hampel | 333/128 |
| 6,198,458 | B1 | * | 3/2001 | Heinz et al. | 343/853 |
| 6,239,744 | B1 | * | 5/2001 | Singer et al. | 342/359 |
| 6,310,585 | B1 | * | 10/2001 | Marino | 343/818 |
| 6,363,263 | B1 | | 3/2002 | Reudink et al. | 455/562 |
| 6,366,237 | B1 | | 4/2002 | Charles | 342/368 |
| 6,411,612 | B1 | | 6/2002 | Halford | 370/347 |
| 6,441,700 | B2 | | 8/2002 | Xu | 333/161 |
| 6,504,510 | B2 | | 1/2003 | Kim | 343/702 |
| 6,504,516 | B1 | | 1/2003 | Davis | 343/853 |
| 6,504,517 | B1 | | 1/2003 | Liu et al. | 343/890 |
| 6,529,166 | B2 | | 3/2003 | Kanamarulu | 313/700 MS |
| 6,573,875 | B2 | * | 6/2003 | Zimmerman et al. | 343/853 |
| 6,642,908 | B2 | * | 11/2003 | Pleva et al. | 343/876 |
| 6,661,375 | B2 | | 12/2003 | Rickett et al. | 342/372 |
| 6,667,714 | B1 | | 12/2003 | Solondzrf | 342/365 |

FOREIGN PATENT DOCUMENTS

| | | |
|---|---|---|
| AU | 664625 | 11/1995 |
| EP | 0 575 808 | 12/1993 |
| EP | 0 860 890 | 8/1998 |
| EP | 0 531 090 | 3/2000 |
| GB | 1 314 693 | 4/1973 |
| JP | 61-006901 | 1/1986 |
| JP | 61-172411 | 8/1986 |
| JP | 02-174302 | 7/1990 |
| JP | 04-320121 | 11/1992 |
| JP | 04-320122 | 11/1992 |
| JP | 05-37222 | 2/1993 |
| JP | 5037222 | 2/1993 |
| JP | 05-075340 | 3/1993 |
| JP | 05-121902 | 5/1993 |
| JP | 05-121915 | 5/1993 |
| JP | 140985 | 5/1994 |
| JP | 06-196927 | 7/1994 |
| JP | 06-260823 | 9/1994 |
| JP | 06-326501 | 11/1994 |
| JP | 11041024 | 2/1999 |
| JP | 200000114 | 1/2000 |
| JP | 2001111473 | 4/2001 |
| WO | WO89/07837 | 8/1989 |
| WO | WO92/16061 | 9/1992 |
| WO | WO93/15569 | 8/1993 |
| WO | WO95/10862 | 4/1995 |
| WO | WO 01/24312 | 4/2001 |

OTHER PUBLICATIONS

Strickland, Peter "Microstrip Base Station Antennas for Cellular Communications", IEEE, pp. 166-171 (1991).

Bacon, "Variable Elevation Beam-Aerial Systems for 1 ½ Metres", Journal IEE, pp. 539-544 (1946).

Forster, et al. "A Conical Beam Ship Array Antenna with Infinitely Variable Control of the Elevation Angle", pp. 17-20 (1973).

Hansen, "Microwave Scanning Antennas" vol. 3 Array Systems, pp. 2-7 (1966).

Smith, textbook: "Circuits, Devices and Systems", A First Course in Electrical Engineering, 4th Ed., pp. 680-681 (1984).

Okuyama et al., "Base-Station Antenna Systems for Car and Handheld Cellular Phones", Mitsubishi Denki Giho, vol. 68, No. 12, pp. 23-26 (1994).

Sumitomo Technical Review, Sep. 1993.

Brochure, "Brown Boveri Phaser for the Horizontal Slewing of Curtain Antennas", Boveri & Cie AG, Mannheim, RFA Classif. n° 1601/242.

CEL-901 Cellular Antenna Controller User's Manual, issued on Apr. 2, 1992, in the name of CAL Corporation (1991).

* cited by examiner

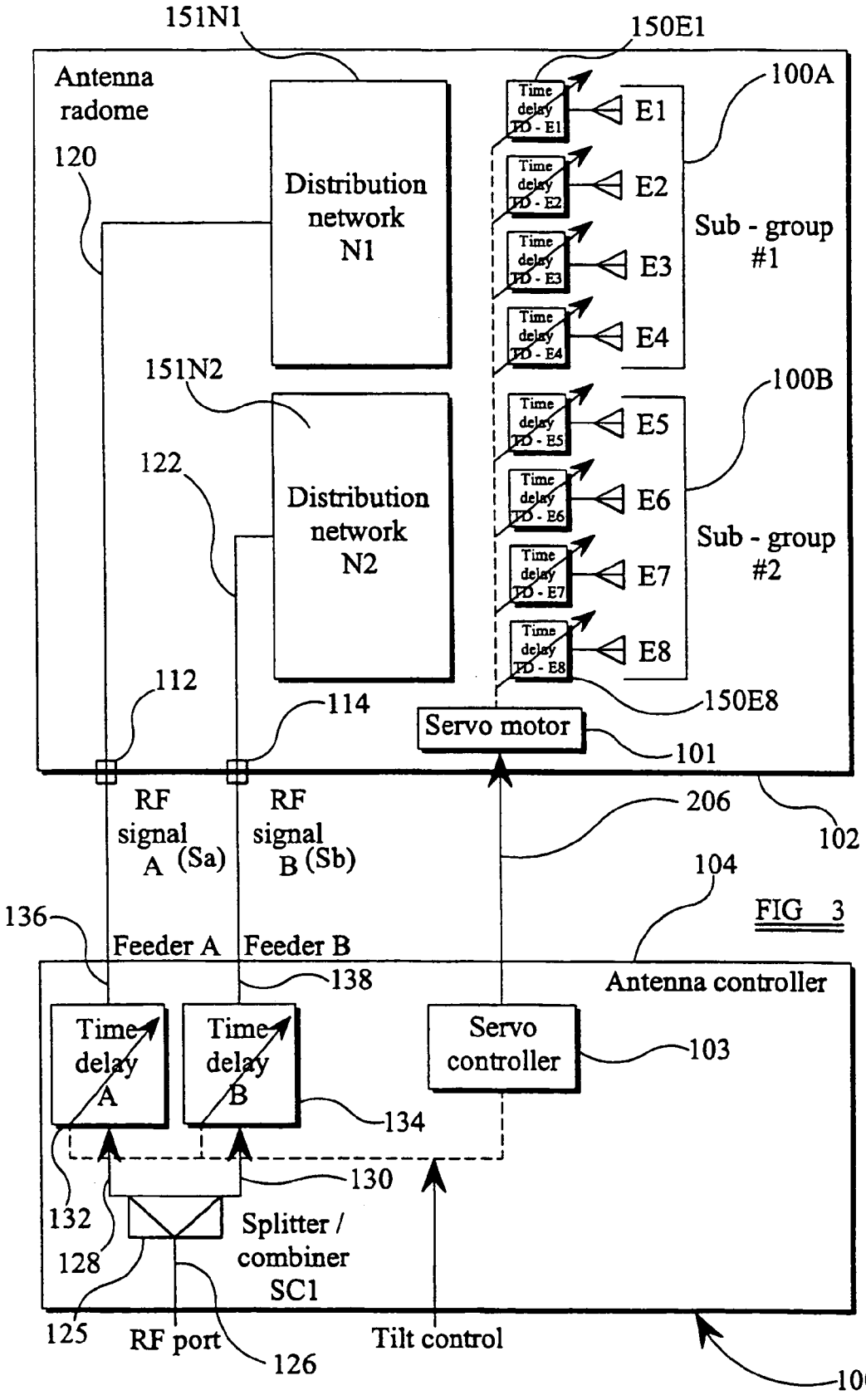
151N1
150E1
Antenna radome
100A
120
Distribution network N1
Time delay TD - E1
E1
Time delay TD - E2
E2
Time delay TD - E3
E3
Time delay TD - E4
E4
Sub - group #1
151N2
100B
Time delay TD - E5
E5
122
Distribution network N2
Time delay TD - E6
E6
Time delay TD - E7
E7
Sub - group #2
Time delay TD - E8
E8
112
114
150E8
Servo motor
101
RF signal A (Sa)
RF signal B (Sb)
206
102
104
FIG 3
136
Feeder A
Feeder B
138
Antenna controller
Time delay A
Time delay B
Servo controller
103
134
130
132
128
Splitter / combiner SC1
125
RF port
126
Tilt control
100

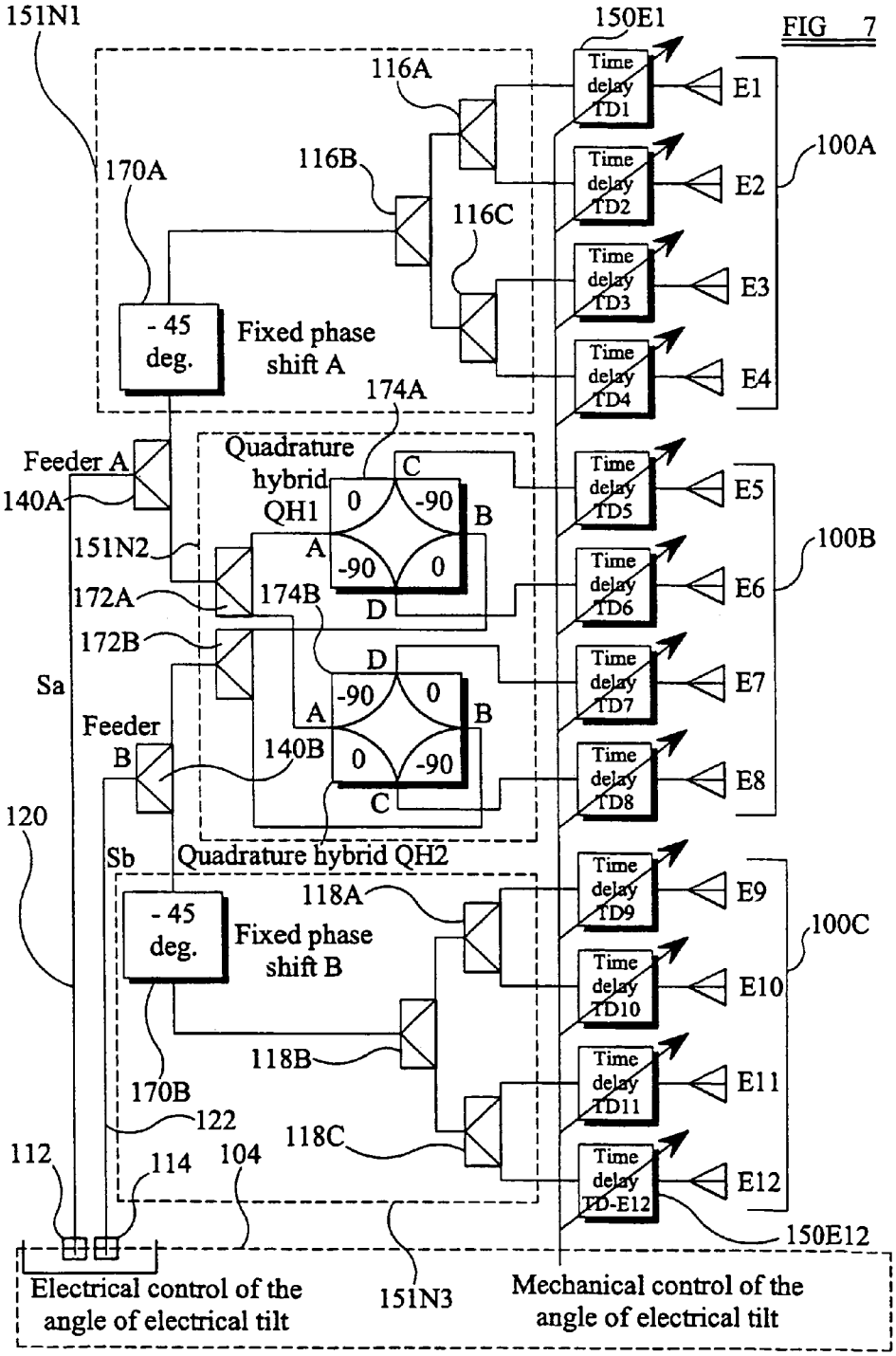
FIG 7
151N1
150E1
116A
116B
116C
170A
- 45 deg.
Fixed phase shift A
174A
Feeder A
140A
Quadrature hybrid QH1
0
-90
-90
0
A
B
C
D
151N2
172A
174B
172B
Sa
Feeder B
140B
Quadrature hybrid QH2
120
Sb
118A
118B
118C
170B
122
112
114
104
151N3
150E12
Time delay TD1
Time delay TD2
Time delay TD3
Time delay TD4
Time delay TD5
Time delay TD6
Time delay TD7
Time delay TD8
Time delay TD9
Time delay TD10
Time delay TD11
Time delay TD-E12
E1
E2
E3
E4
E5
E6
E7
E8
E9
E10
E11
E12
100A
100B
100C
Electrical control of the angle of electrical tilt
Mechanical control of the angle of electrical tilt

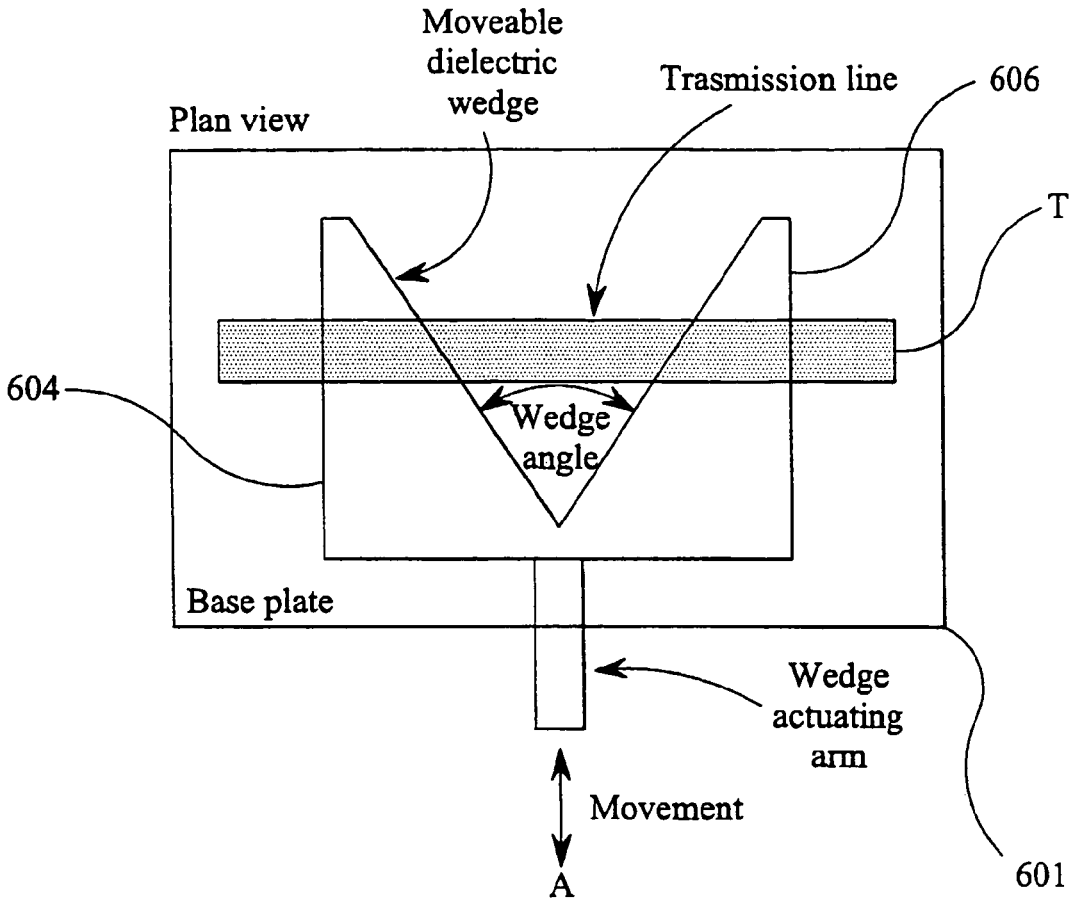
FIG 9
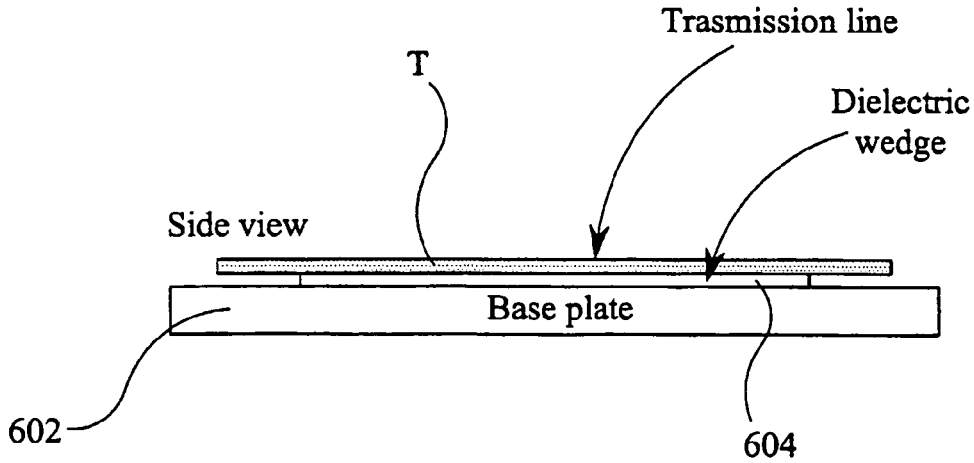

ANTENNA SYSTEM

BACKGROUND OF THE INVENTION (1) Field of the Invention

The present invention relates to an antenna system and particularly, but not exclusively, to a phased array antenna system having a plurality of antenna elements arranged in at least two sub-arrays. The antenna system is suitable for use in many telecommunications systems but finds particular application in cellular mobile radio networks, commonly referred to as mobile telephone networks. More specifically, the antenna system of the present invention may be used with third generation (3G) mobile telephone networks and the Universal Mobile Telephone System (UMTS).

(2) Description of the Art

Operators of cellular mobile radio networks generally employ their own base-stations, each of which includes one or more antennas. In a cellular mobile radio network, the antennas are a factor in defining the desired coverage area which is generally divided into a number of overlapping cells, each associated with a respective antenna and base station. Each cell contains a fixed-location base station which communicates with mobile radios in that cell. The base stations themselves are interconnected by other means of communication, either radio links or fixed land-lines, and are arranged in a grid or meshed structure allowing mobile radios throughout the cell coverage area to communicate with each other as well as with the public telephone network outside the cellular mobile radio network.

The antennas used in such networks are often composite devices known as phased array antennas which comprise a plurality (usually eight or more) or array of individual antenna elements or dipoles. The direction of maximum sensitivity of the antenna, i.e. the vertical or horizontal direction of the main radiation beam or "boresight" of the antenna pattern, can be altered by adjusting the phase relationship between the elements. This has the effect of allowing the beam to be steered to modify the coverage area of the antenna.

In particular, operators of phased array antennas in cellular mobile radio networks have a requirement to adjust the vertical radiation pattern (VRP), also known as the "tilt", of the antenna since this has a significant effect on the coverage area of the antenna. Adjustment of the coverage area may be required, for example, owing to changes in the network structure or the addition or removal of other base stations or antennas in the cell.

The adjustment of the angle of tilt of an antenna is known and is conventionally achieved by mechanical means, electrical means, or both, within the antenna itself. When tilt is adjusted mechanically, for example by mechanically moving the antenna elements themselves or by mechanically moving the housing for the elements, such an adjustment is often referred to as "adjustment of the angle of mechanical tilt". The effect of adjusting the angle of mechanical tilt is to reposition the boresight such that it points either above or below the horizon. When tilt is adjusted electrically, by adjusting the phase of signals supplied to the antenna elements without physically moving either the housing for the elements, the antenna elements themselves or any other part of the antenna radome, such an adjustment is commonly referred to as "adjustment of the angle of electrical tilt". The effect of adjusting the angle of electrical tilt is also to reposition the boresight so that it points either above or below the horizon but, in this case, is achieved by changing the time delay of signals fed to each element (or group of elements) in the array.

A disadvantage of mechanical adjustment of the angle of electrical tilt is that it must be carried out in situ by manual mechanical adjustment of the antenna.

SUMMARY OF THE INVENTION

It is an object of the present invention to provide an improved antenna which overcomes the aforementioned problem.

In the following description, the term "antenna system" is used in place of the previous term "antenna" to describe a system having an "antenna assembly", that is an array of antenna elements, and control means for controlling signals supplied to the antenna elements in the antenna assembly.

According to one aspect of the present invention, therefore, there is provided an antenna system comprising:

an antenna assembly having an angle of electrical tilt and a plurality of antenna elements mounted upon an antenna carrier and arranged in at least two sub-arrays, each sub-array including one or more of said elements, control means for controlling electrically the phase of signals supplied to at least one of said sub-arrays from a location remote from said antenna assembly, wherein said control means include phase adjustment means for connection through first and second input feeds to a respective one of said sub-arrays, thereby to adjust the phase of signals applied thereto, and an additional mechanical phase adjustment arrangement for further adjusting the phase of signals supplied to each element of the antenna assembly.

Advantageously, the antenna assembly may comprise first and second phase adjustment means, each of said first and second phase adjustment means being in connection with a respective one of said sub-arrays through the respective first or second input feed, thereby to adjust the phase of signals supplied to said respective one of said sub-arrays.

Typically, the antenna carrier may be a mast.

In a first embodiment, the control means may be located at a base of the antenna carrier, remote from the antenna assembly. In an alternative embodiment, the control means are arranged at a distant location from the base of the antenna carrier or mast, for example several kilometers away.

The control means may include a single port for receiving a single input signal and means for splitting said input signal into first and second split signals to be supplied to a respective one of said first and second phase adjustment means.

Advantageously, the system further comprises means for automatically controlling the phase of signals supplied to a first one of said arrays in dependence on the phase of signals supplied to a second one of said arrays.

In one preferred embodiment, said elements in said antenna assembly are arranged in first, second and third sub-arrays and said antenna system comprises:

first control means for controlling the phase of signals supplied to said first sub-array, and third control means for controlling the phase of signals supplied to said third sub-array, and second control means arranged to control automatically the phase of signals supplied to said second sub-array in dependence on a predetermined function of the phase of the signals supplied to said first and third sub-arrays.

Advantageously, said predetermined function is the vector sum of the phase of the signals supplied to said first and third sub-arrays.

Said second control means may preferably include a combiner unit for receiving a first input signal having the phase of the signals supplied to said first sub-array and a second input signal having the phase of signals supplied to said third sub-array, and for providing an output signal to the second sub-array in dependence on the predetermined function of the phase of the signals supplied to said first and third sub-arrays.

In one embodiment, the predetermined function is the vector sum of the phases of the signals supplied to said first and third sub-arrays.

In a further preferred embodiment, the second control means includes at least one quadrature combiner unit for receiving a first input signal having the phase of signals supplied to the first sub-array and a second input signal having the phase of signals supplied to the third sub-array and for providing a first output signal to one element of the second sub-array and a second output signal to a different element of the second sub-array, wherein said first and second output signals are dependent upon the predetermined function of the phase of the first and second input signals.

The quadrature combiner unit may be configured such that the phase of said output signals provided by the quadrature combiner unit is the average of the phase of said first and second input signals.

The first control means may be arranged to control and/or adjust the phase of said signals supplied to said first sub-array by a first predetermined amount and said second control means may be arranged to control and/or adjust the phase of said signals supplied to said second sub-array by a second predetermined amount, wherein the magnitude and/or polarity of said second predetermined amount is different to that of said first predetermined amount.

The antenna assembly is conveniently supplied with a maximum of two signal feeds from said first and second phase adjustment means.

The antenna assembly conveniently includes respective signal distribution means associated with each sub-array for splitting and distributing signals across the elements of the associated sub-array. Preferably, each of said signal distribution means includes a splitter arrangement for distributing signals to one or more of said sub-arrays. Conveniently, the splitter arrangement is arranged to distribute signal strength of said signals to said sub-arrays in a substantially uniform distribution, thereby to increase antenna boresight gain.

In one embodiment, at least one output signal from said distribution means associated with a first sub-array is spatially combined or overlapped with at least one output signal from said distribution means associated with a third sub-array, thereby to provide first and second combined output signals to first and second elements of a second sub-array. The combining of signals may be achieved simply in air, and provides the further advantage that higher boresight gain and lower sidelobe levels may be achieved, particularly when the system is electrically tilted.

The additional mechanical phase adjustment arrangement may include an array of moveable dielectric elements. The signal path to each array element may provided with an associated dielectric element, unique to that element, or may share a dielectric element with the signal path to another of the array elements.

Each element has an associated input transmission line and, in one embodiment, each of the dielectric elements is arranged for linear movement relative to the associated transmission line to vary the further phase shift of signals supplied to said element through said transmission line.

Alternatively, each of the dielectric elements is arranged for rotary movement relative to the associated transmission line to vary the further phase shift of signals supplied to said element through said transmission line.

The additional mechanical phase adjustment arrangement may therefore include either rotary or linear actuation means for moving the dielectric elements. Each additional mechanical phase adjustment arrangement may be identical, so as to provide a substantially equal amount of further phase adjustment to signals supplied to each array element upon linear or rotary actuation of the dielectric elements. Alternatively, each additional mechanical phase adjustment arrangement may be different such that linear or rotary actuation generates a different amount of further phase adjustment to signals to each element.

According to another aspect of the present invention, there is provided an antenna system comprising:

an antenna assembly having a plurality of elements arranged in at least two sub-arrays, each sub-array comprising one or more of said elements;

first control means for controlling the phase of signals supplied to a first one of said arrays; and second control means for automatically controlling the phase of signals supplied to another of said sub-arrays in dependence on the phase of said signals supplied to said first one of said sub-arrays.

Preferably, said elements in said antenna assembly are arranged in first, second and third sub-arrays and said assembly includes:

first control means for controlling the phase of signals supplied to said first sub-array; and third control means for controlling the phase of signals supplied to said third sub-array;

and wherein said second control means is arranged to control automatically the phase of said signals supplied to said second sub-array in dependence on a predetermined function of the phase of said signals supplied to said first and third sub-arrays.

Advantageously, the predetermined function is the vector sum of the phase of the signals supplied to said first and third sub-arrays.

It will be appreciated that the features described as optional and/or alternatives of the first aspect of the invention may also be applicable to the further aspects of the invention.

According to yet a further aspect of the present invention, there is provided an antenna system comprising:

an antenna assembly having a plurality of elements arranged into at least first, second and third sub-arrays, each array comprising one or more of said elements; and control means for controlling the phase of signals supplied to each of said sub-arrays;

wherein said antenna assembly is supplied with a maximum of two signal feeds.

The systems of the invention as described in the preceding paragraphs provide several advantages over existing systems. In particular, control and/or adjustment of the phases of signals supplied to each sub-array in the antenna assembly can be achieved simply and quickly and from a location remote from the antenna assembly. It is known to adjust the angle of tilt of an antenna by manual mechanical adjustment of the antenna elements and/or the antenna housing mounted on the antenna carrier or mast itself. Such an adjustment process is inconvenient and labour intensive. The present invention provides the advantage that the angle of tilt can be adjusted from a location remote from the antenna mast by electrical means, for example from a base station or control centre at the base of the antenna mast, or a base station situated several kilometers from the mast. Moreover, the system is appropriate for multi-user (i.e. multi operator) applications, by providing each user with independently operable control means, and by combining the user signals in a frequency selective combiner device.

The invention also provides the advantage that the distribution of the phase and amplitude of the signals fed to each antenna element is controlled so as to provide improved control of the antenna gain and side lobe level, particularly when the system is electrically tilted. The provision of the mechanical phase adjustment means, for example, for further adjusting the phase of signals supplied to each element of the array, provides the user with a means of fine tuning the vertical radiation pattern, to permit further optimisation of the boresight gain and sidelobe levels.

This aspect of the invention also provides an advantage over other known techniques in that a reduction in the number of components required to adjust the electrical tilt of the antenna assembly may be achieved with a corresponding reduction in system complexity and cost.

For the purpose of this specification, it will be appreciated that the phrase "user" is intended to mean the user of the system of the invention (i.e. a system operator), and not the user of the telephone handset for receipt/transmission of signals to/from the system.

The present invention will now be described, by way of example only, with reference to the accompanying drawings in which:

DESCRIPTION OF THE FIGURES

FIG. 3 is a schematic block diagram of a first embodiment of a dual sub-array antenna system according to the invention, FIG. 7 shows a schematic block diagram of a practical implementation of the antenna system in FIG. 6, FIG. 9 illustrates one embodiment of the mechanical phase adjustment arrangement forming part of the system in FIGS. 3 to 8.

Figure 1:
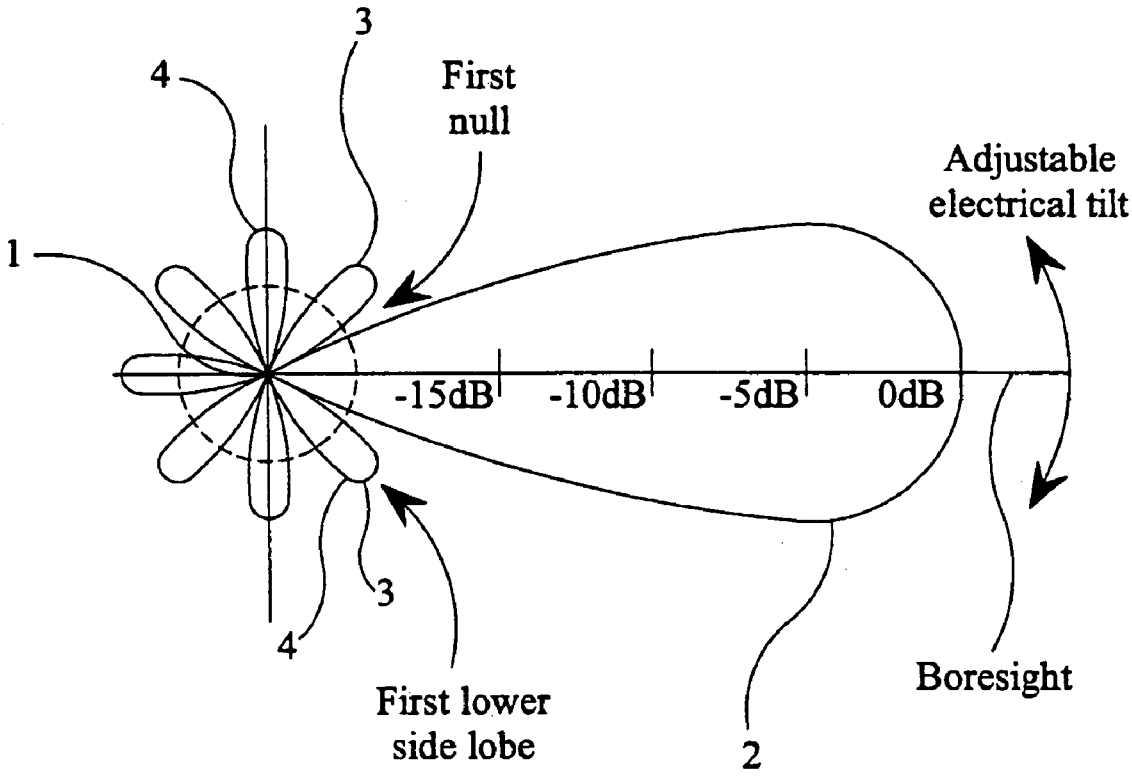
FIG. 1 illustrates the vertical radiation pattern (VRP) of a known phased array antenna assembly.

In the drawings, like reference numerals are used to denote similar parts. In the following description, the invention is described in the context of an antenna system suitable for use in a cellular mobile radio network and particularly the Universal Mobile Telephone System (UTMS). However, it will be appreciated that the invention is not confined to such use and may be equally applicable to other communications systems.

DETAILED DESCRIPTION OF THE INVENTION

FIG. 1 shows the vertical radiation pattern (VRP) of a conventional phased array antenna assembly. The drawing is shown in side view and the antenna assembly is represented by the point 1.

The VRP of the antenna assembly 1 consists of a main lobe or "boresight" 2 which diverges in a vertical plane as it extends from the antenna assembly and represents the region of maximum radiation intensity of the beam radiated by the antenna assembly. The VRP of the antenna assembly also includes a number of side lobes 4, representing regions of much lower radiation intensity, which extend from the antenna assembly in directions which are approximately equiangularly spaced about the antenna assembly in a vertical plane. The lobes 3 immediately adjacent the boresight 2 are termed the first upper and first lower side lobes respectively.

The angle of tilt of the antenna assembly, when adjusted mechanically by physically moving the antenna elements and/or their housing or casing, is known as the angle of "mechanical tilt" and is conventionally achieved by repositioning the boresight so that it points either above or below the horizon. When adjusted electrically, the tilt of the antenna assembly is known as "electrical tilt" and moves the boresight line up or down by changing the time delay or phase of signals supplied to groups of elements in the antenna, rather than by mechanical movement of the elements themselves. The time delay may be achieved by changing the phase of the radio frequency carrier. Providing that the phase delay is proportional to frequency across the band of interest, and has zero intercept, then the phase delay produces a time delay. Phase shift and time delay are thus synonymous.

It will benefit the reader's understanding of the following description to note that both "electrical tilt" and "mechanical tilt" may be controlled and/or adjusted either by electrical means, or by mechanical means, or both means, such that, for example, mechanical movement of parts may be used to implement electrical phase adjustment in which the antenna elements themselves are not physically moved to adjust the position of the boresight.

Figure 2:
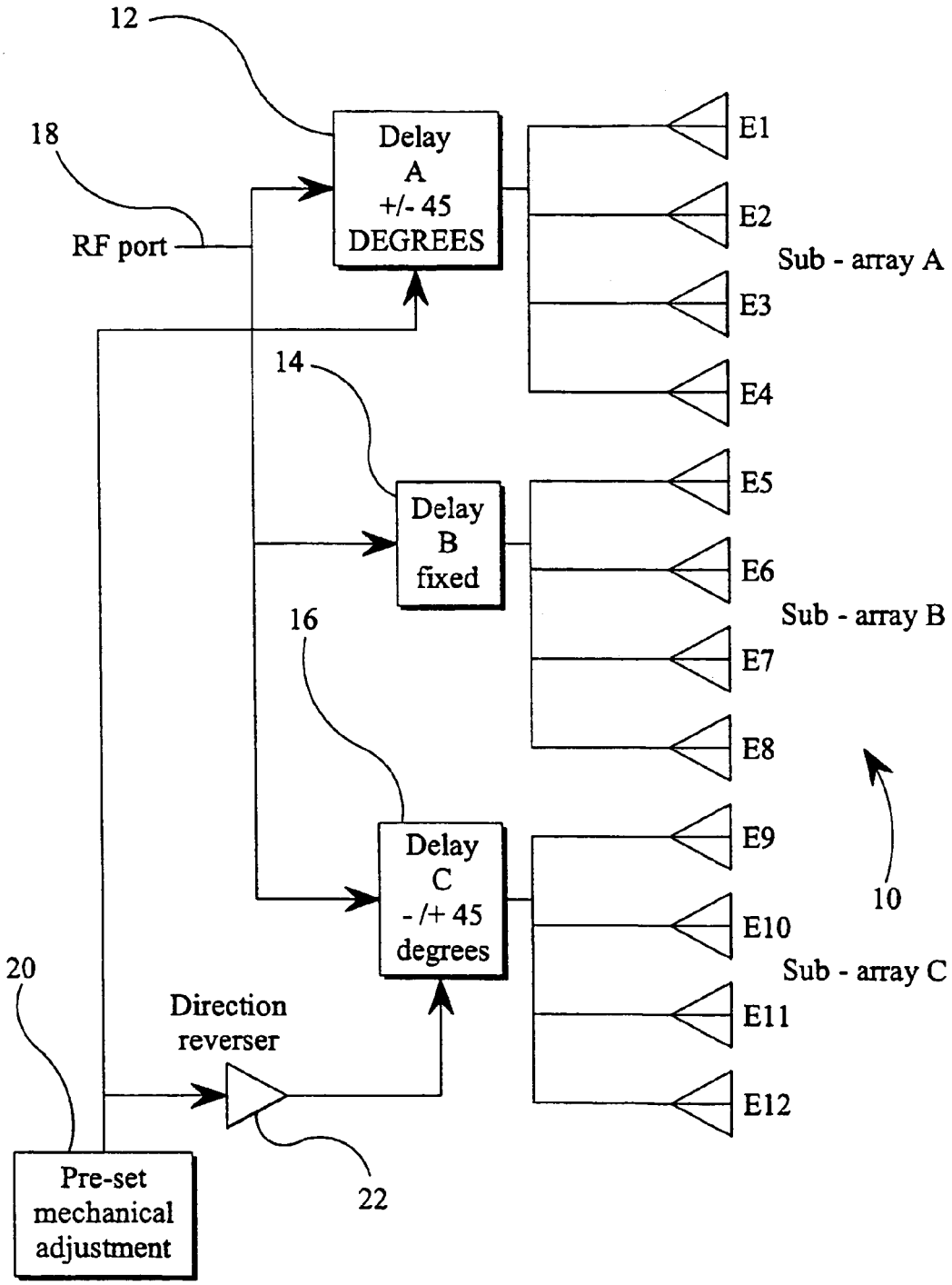
FIG 2 (PRIOR ART)
FIG. 2 is a schematic block diagram of a known antenna assembly incorporating mechanical means for adjusting the angle of electrical tilt.

In FIG. 2, the antenna assembly of a known antenna system incorporating a mechanical means of adjusting the angle of electrical tilt is shown in schematic block form generally at 10. The antenna assembly is a phased array antenna consisting of an array of twelve elements or dipoles E1–E12 which are arranged into three sub-arrays labelled A, B and C.

Each sub-array A, B, C includes four elements, mutually connected in parallel, and is coupled to the output of respective first, second and third delay devices 12, 14, 16. The delay devices 12, 14, 16 comprise conventional mechanical phase adjustment mechanisms of the type shown in FIGS. 9 and 10 and described in further detail below. A radio frequency (RF) signal to be transmitted by the antenna is supplied to each of the delay devices 12, 14, 16 from a common RF port or feeder 18.

The function of the delay devices 12, 14, 16 is to adjust the phase of the RF signal supplied to the respective sub-array A, B, C by a predetermined amount. The second delay device 14, connected to the centre sub-array B, is a fixed delay device, arranged to shift the phase of the signal supplied to sub-array B by a fixed amount. On the other hand, the first and third delay devices 12, 16, connected to sub-arrays A and C respectively, are variable delay devices, each of which is operable to shift the phase of the RF signals supplied to sub-arrays A and C respectively, by a variable amount.

Figure 6:
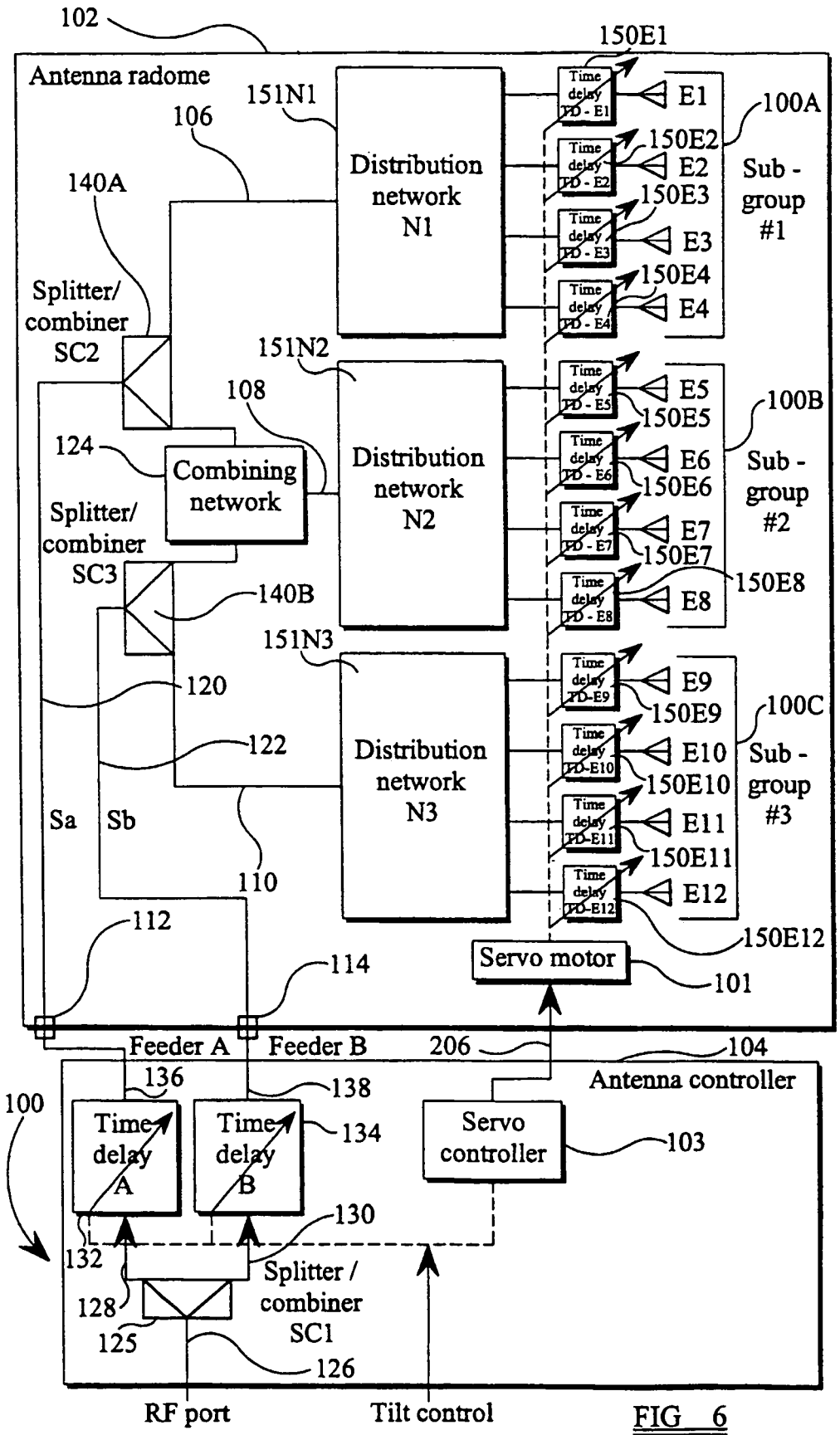
FIG. 6 shows a schematic block diagram of an alternative triple sub-array antenna system to that shown in FIG. 5.

The first and third delay devices 12, 16 can apply phase shifts of, typically, between 0 and ±45° to the RF signal supplied to sub-arrays A and C and are adjustable by means of a mechanical arrangement 20 such as that shown in FIGS. 6 and 7. The mechanical arrangement 20 includes means, shown representatively at 22, for reversing the direction of the phase shift applied to the signal by the third delay device 16 compared with that applied by the first delay device 12. Thus, the phase shift applied to the RF signals by the first and third delay devices 12, 16 is equal in magnitude but opposite in polarity. In other words, if the first delay device 12 shifts the phase of the signal supplied to sub-array A by +45°, then the third delay device 16 shifts the phase of the signal supplied to sub-array C by −45°. As the second delay device 14 is a fixed delay device, in practice a phase shift is applied to the signal supplied to sub-array B which is the median of the shifts applied by the first and third delay devices 12, 16.

The angle of electrical tilt of such an antenna assembly typically varies by ±5° for ±45° of phase shift per sub-array. This gives a tilt sensitivity of approximately 18° of phase shift per degree of electrical tilt. In this example, therefore, since the RF signals supplied to sub-arrays A and C differ by 90°, the electrical tilt of the antenna assembly is approximately 5°. The direction of electrical tilt of the antenna assembly depends on the polarity of the phase shift applied to the signals supplied to the sub-arrays. Where the signal to the upper sub-array (in this case sub-array A) has a positive phase and the lower sub-array (in this case sub-array C) has a negative phase shift, the angle of electrical tilt will be positive, i.e. above the normal boresight line. For phase shifts of opposite polarity the angle of electrical tilt will be negative.

The antenna assembly of FIG. 2 suffers from a number of disadvantages. In particular, manual adjustment of the mechanical arrangement 20 is required to adjust the phase shift applied by the first and third delay devices 12, 16 in order to vary the angle of electrical tilt of the antenna assembly. Moreover, owing to the provision of a common mechanical adjustment arrangement 20, the magnitude of the phase shifts applied by the first and third delay devices 12, 16 is always equal in magnitude and opposite in direction (polarity), thereby limiting the tilt of the antenna assembly. In addition, the side lobe level is increased relative to that of the boresight. As a consequence, the gain of the antenna assembly is disadvantageously reduced.

In FIG. 3, a preferred form of antenna system according to the invention is shown in block form generally as 100. In this embodiment, the antenna system 100 comprises an antenna assembly shown at 102 and a control unit 104. The antenna assembly 102 comprises a phased array antenna having an array of eight elements E1 to E8 mounted upon an antenna carrier or mast (not shown). The elements E1 to E8 are arranged into two sub-arrays: an upper sub-array 100A, comprising elements E1 to P4, and a lower sub-array 100B comprising elements E5 to E8. The elements in each of the sub-arrays 100A, 100B, are connected in parallel to respective signal distribution means in the form of distribution networks 151N1, 151N2. The distribution networks 151N1 and 151N2 are fed through carrier lines 120, 122 respectively, and will be described in further detail hereinafter.

The antenna assembly 102 includes two input ports represented by squares 112, 114, each of which is connected to the respective distribution network 151N1, 151N2 via the respective input carrier line 120, 122. The control unit 104 also includes an input splitter/combiner unit 125, the common port to which is connected to the output of a single RF port 126. The input splitter/combiner unit 125 has two ports which are connected, via first and second splitter lines 128, 130, to first and second phase adjusters 132, 134 respectively. The first phase adjuster 132 is connected at its output to input port 112 via a first input feeder line 136 whilst the second phase adjuster 134 is connected to input port 114 via a second input feeder line 138. The antenna assembly 102 is therefore provided with signals from the control unit 104 through dual feeder lines.

In addition to the phase adjustment implemented by the first and second phase adjusters 132, 134, additional phase adjustment means 150E1–150E8 are provided in the signal path to each element of the assembly, each additional phase adjustment means 150E1–150E8 taking the form of a mechanical phase adjustment arrangement of the type described in further detail below with reference to either FIG. 9 or 10. Each of the mechanical phase adjustment arrangements 150E1–150E8 serves to further adjust the phase of signals supplied to the individual elements in each sub-array 100A, 100B, as is controlled by means of a servo motor 101 under the control of a servo controller 103. The servo controller 103 controls the servo motor 101 through a control cable 206, which may be of sufficient length so that the servo controller 103 may form part of the control unit 104 located remotely from the antenna assembly 100.

Figure 4:
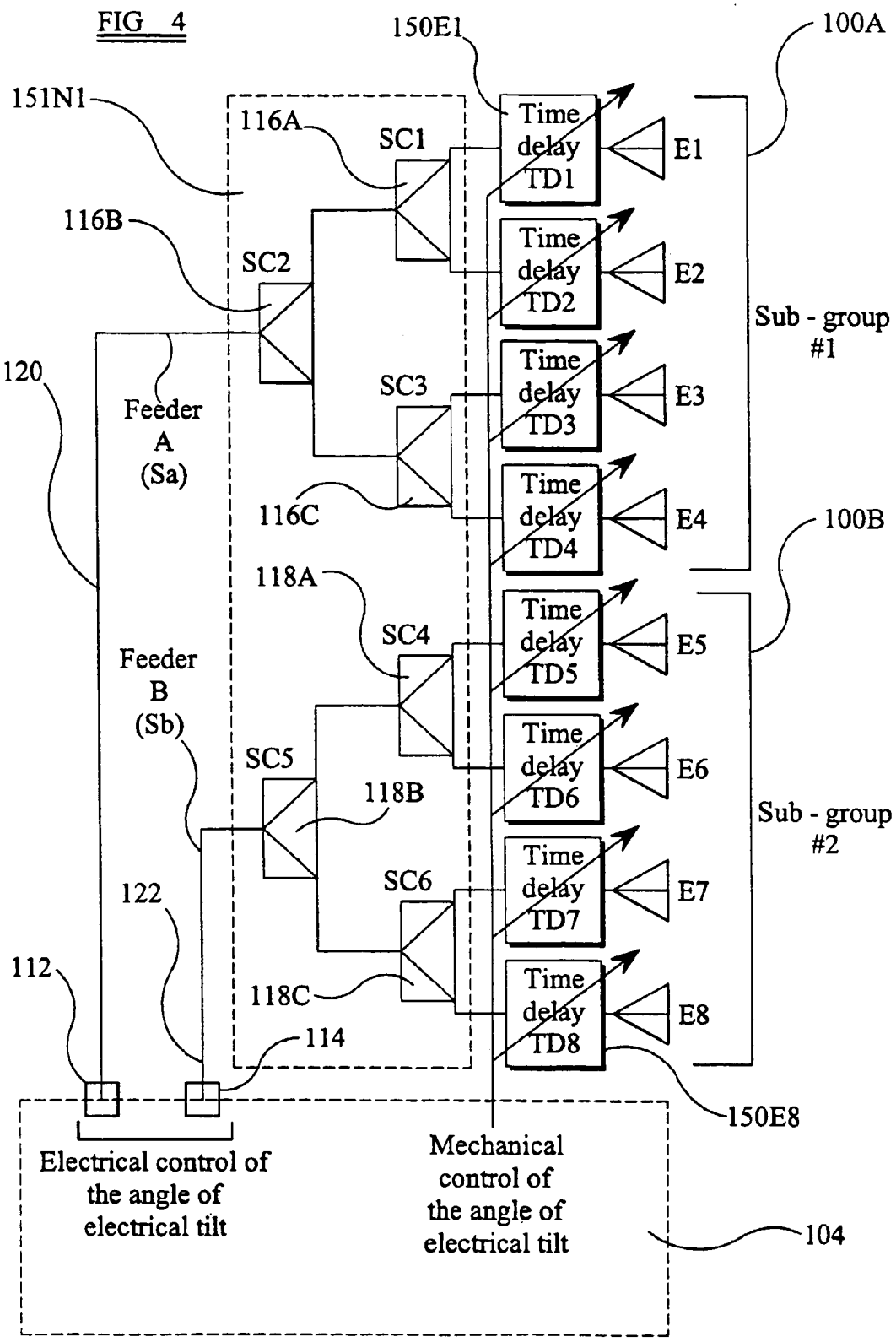
FIG. 4 is a schematic block diagram of a practical implementation of the antenna system in FIG. 3.

The distribution networks 151N1, 151N2 are shown in further detail in FIG. 4. The first distribution network 151N1 associated with the upper sub-array 100A includes first, second and third splitter/combiner units 116A, 116B, 116C respectively. The input carrier line 120 supplies a signal to the second splitter/combiner unit 116B, which supplies first and second output signals of substantially equal strength to a respective one of the first and third splitter/combiner units 116A, 116C. The first and third splitter units 116A, 116C, further divide the signal so that each provides first and second output signals of substantially equal strength to a respective one of the phase adjustment means 150E1 to 150E4. The second distribution network 151N2 for the lower sub-array 100B includes an identical arrangement of splitter units 118A, 118B, 118C. The arrangement of splitter/combiner units 116A–116C, 118A–118C ensures an equal power distribution to each element E1 to E8 of the array, and thus also ensures maximum boresight gain and that the beam pattern is the same in both transmit and receive modes.

Referring to FIGS. 3 and 4, in operation a signal to be transmitted by the antenna system is fed from the RF port 126 to the input of the input splitter unit 125. The input splitter unit 125 splits the signal into two output signals of equal strength and supplies one split signal to each of the first and second phase adjusters 132, 134 respectively. The first and second phase adjusters 132, 134 are operable to adjust the phase of the signal supplied thereto within a range of ±60°. Each phase adjuster 132, 134 is controlled such that, if the first phase adjuster 132 is arranged to apply a positive phase shift to the RF signal, the second phase adjuster 134 is arranged to apply a negative phase shift to the signal, and vice versa. However, each phase adjuster is arranged to adjust the phase of the signal supplied thereto independently so that the magnitude of the phase shift applied by each phase adjuster may be different.

The phase shifted signal from the first phase adjuster 132 is supplied to the input port 112 on the antenna assembly 102 via the first feeder line 136. Similarly, the phase adjusted signal from the second phase adjuster 134 is supplied to the input port 114 via the second feeder line 138. In practice, the first and second feeder lines 136 and 138 can be made as long as desired so that the control means 104 for adjusting the angle of electrical tilt of the antenna assembly 102 can be situated in a location remote from the antenna assembly itself.

The phase shifted signals supplied to input ports 112, 114 are supplied as signals Sa and Sb, on the input carrier lines 120, 122, to the first and second primary splitter units 116B, 118B respectively. The first primary splitter unit 116B serves to split the signal Sa and supplies the split signal from its two outputs to the elements in sub-array 100A via the upper sub-array splitter units 116A, 116C and the associated phase adjustment arrangements 151E1 to 150E4.

Similarly, the second primary sub-array splitter unit 118B serves to split signal Sb and supplies the split signal from its two outputs to the elements in sub-array 100C via the lower sub-array splitter units 118A, 118C and the associated phase adjustment arrangements 151E5 to 150E8.

The manner in which the signals Sa, Sb are split and distributed to the elements in the antenna assembly will immediately be appreciated by those skilled in the art from the way in which the splitter units are interconnected. That is, the signal strength of each of the two signal outputs for a splitter unit will be substantially half that of the input signal strength. Thus, the signal strength of the signal supplied to each element E1 to E8 is substantially the same.

Figure 5:
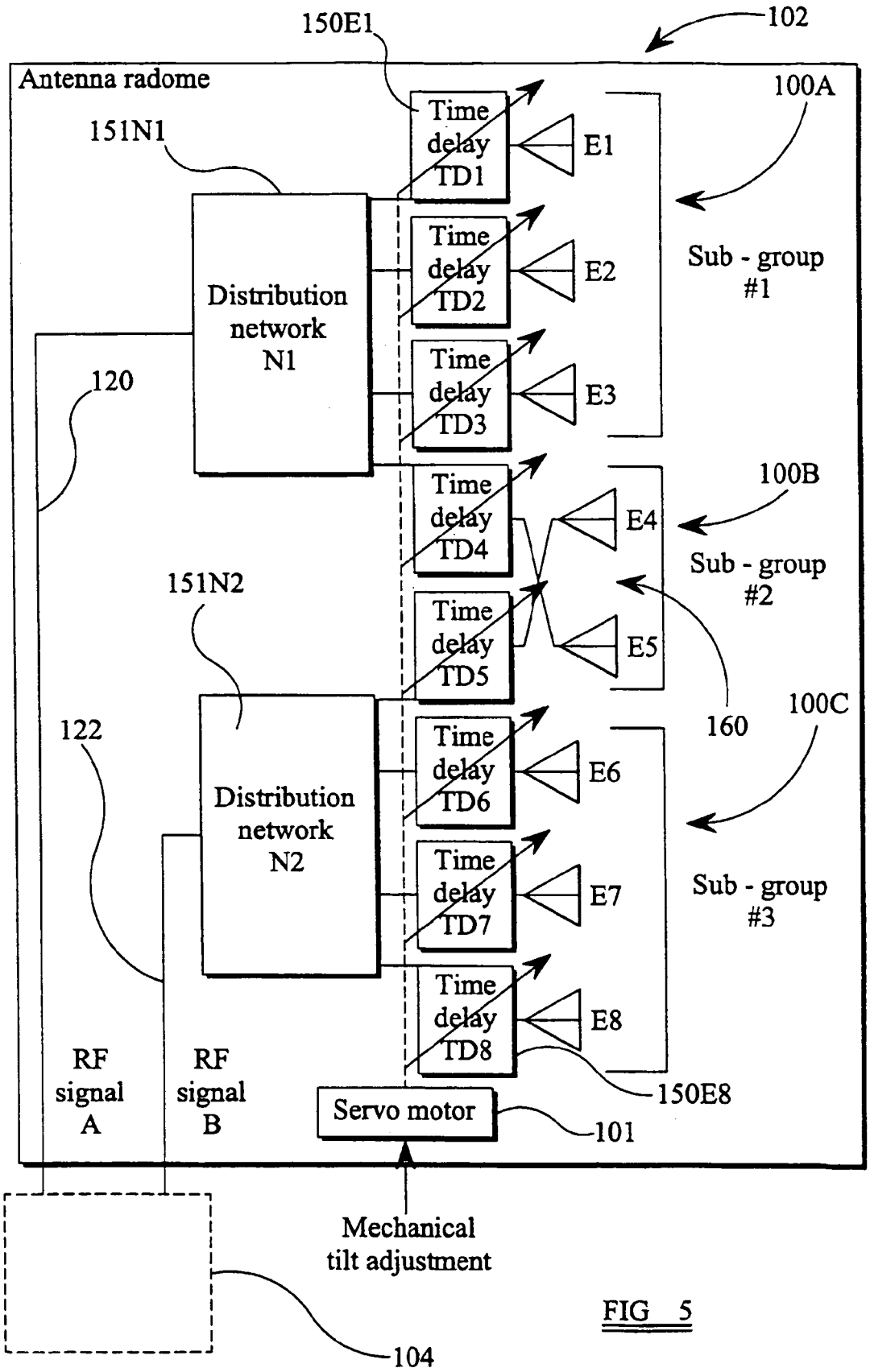
FIG. 5 is a schematic block diagram of a triple sub-array antenna system of an alternative embodiment, using spatial over-lapping of sub-arrays.

FIG. 5 is an alternative embodiment to that shown in FIGS. 3 and 4, in which the antenna assembly 102 includes eight antenna elements E1 to E8 arranged in three sub-arrays; an upper sub-array 100A including antenna elements E1 to E3, a centre sub-array 100B including E4 and E5 and a lower sub-array 100C including antenna elements E6 to E8. Each of the elements E1 to E4 (i.e. three elements of the upper sub-array 100A and one element of the centre sub-array 100B) is fed by the distribution network 151N1, and is provided with an additional phase adjustment means 150E1–150E4 respectively. Each of the elements E5 to E8 (i.e. the three elements of the lower sub-array 100C and one of the elements of the centre sub-array 100B) is fed by the other distribution network 151N2, and is provided with an associated additional phase adjustment means 150E5–150E8 respectively. The phase adjusted signals to the centre sub-array elements, 150E4 and 150E5, are derived by spatially combining, in air at 160, one of the output signals from the first distribution network 151N1 and one of the output signals from the second distribution network 151N2. Air combining of the two signals to derive the inputs to the centre sub-array 100B occurs after the output signals from the distribution networks 151N1, 151N2 have passed through the associated phase adjustment arrangement 150E4, 150E5.

The distribution networks 151N1, 151N2 in FIG. 5 may include substantially identical splitter arrangements to those shown in FIG. 4. Thus, the outputs from the first splitter unit 116A of the first distribution network 151N1 feed elements E1 and E2, and one of the outputs from the third splitter unit 116C feeds element E3. As the feeds to elements E4 and E5 are interchanged in the FIG. 5 embodiment, the second output from the third splitter unit 116C of the first distribution network 151N1 feeds element E5. Similarly, the two outputs from the third splitter unit 118C of the second distribution network 151N2 feed elements E7 and E8, and one of the outputs from the first splitter unit 118C feeds element E6. As the feeds to elements E4 and E5 are interchanged, one of the outputs from the first splitter unit 118A of the second distribution network 151N2 feeds element E4.

An advantage is obtained by spatially overlapping two of the elements from the upper and lower sub-arrays 100A, 100C to derive the inputs to the centre sub-array 100C, in that the phase distribution across the array elements is a closer approximation to a linear distribution. Higher bore-sight gain and lower side-lobe levels can therefore be achieved, particularly when the antenna is electrically tilted.

FIG. 6 shows a further alternative embodiment of the antenna assembly, in the form of a triple-sub group, variable electrical tilt assembly. The antenna assembly 102 includes twelve elements, E1 to E12, divided into three sub-arrays 100A, 100B, 100C such that each sub-array includes four elements, E1 to E4, E5 to E8 and E9 to E12 respectively. Similar parts to those shown in the embodiments of FIGS. 3 to 5 are indicated with like reference numerals, and will not be described in further detail. The input carrier lines 120, 122 feed respective signals Sa and Sb to primary splitter units 140A, 140B respectively, each of which provides two outputs of equal strength. The first output of the first primary splitter unit 140A is connected to a first output carrier line 106 and the second output of the first primary splitter unit 140A is connected to a first input of a combiner unit 124. The first output of the second primary splitter unit 140B is connected to a second output carrier line 110, while the second output of the second primary splitter unit 140B is connected to a second input of the combiner unit 124.

The combiner unit 124 is operable to output the vector sum of the two signals on an output carrier line 108. As the signal strength of each of the signals input to the combiner unit 124 is half that of the signals Sa, Sb, having been halved by the first and second primary splitter units 140, 140B respectively, in combining the signals output from the first and second primary splitter units 140A, 140B, the signal output by the combiner unit 124 has the same signal strength as either of the signals Sa, Sb. In addition, since the combiner 124 unit generates the vector sum of the two signals Sa, Sb, and since the phase of the signals Sa, Sb has been adjusted differentially (i.e. at opposite polarities), the phase of the signals output by the combiner unit 124 along line 108 is the median of the phases of Sa and Sb. Furthermore, the combiner unit 124 provides the median of the phases of signals Sa and Sb without any loss of the signal power to sub-group 100B.

The combiner unit 124 provides the vector-summed signal on the carrier line 108 to the second distribution network 151N2, which in turn provides signals to each of the elements E5 to E8 through the associated phase adjustment means 150E5 to 150E8. This configuration provides a further improvement in phase linearity, as the output from the combiner unit 124 is the average phase of the signal on the input carrier lines 120, 122. Thus, the total power fed to the elements of the centre sub-array 100B (elements E5 to E8) remains substantially constant with phase difference between the carrier lines 120, 122.

FIG. 7 shows a practical embodiment of the triple sub-group antenna assembly in FIG. 6, to show the distribution networks 151N1, 151N2, 151N3 in more detail. The first and second splitter units 140A, 140B are fed by a respective one of the input carrier lines 120, 122, and each of the splitter units 140A, 140B produces two output signals. The first output signal from the first splitter unit 140A is supplied to a phase shift unit 170A of the first distribution network 151N1 to apply an additional phase shift, typically between −45 and −60 degrees, to the signal from the primary splitter unit 140A. The phase shifted output signal is provided to a splitter unit 116B forming part of a splitter arrangement 116A, 116B, 116C of the kind shown in FIG. 4. The splitter arrangement 116A, 116B, 116C provides output signals to the phase adjustment means 150E1–150E4 respectively, so that each element receives a signal of substantially equal strength.

A second output from the splitter unit 140A is provided to a further splitter unit 172A forming part of the second distribution network 151N2, which splits the input it receives into a first output signal which is provided to one input (A) of a first quadrature hybrid combiner unit 174A and a second output signal which is provided to an input (A) of a second quadrature combiner unit 174B.

The second splitter unit 140B provides a first output signal to a further splitter unit 172B forming part of the second distribution network 151N2.

The further splitter unit 172B provides an output signal to a second input (B) of the first quadrature combiner unit 174A and to a second input (B) of the second quadrature combiner unit 174B.

Each of the first and second quadrature combiner units 174A, 174B provides first and second output signals to two elements of the centre sub-array 100B: the first quadrature combiner unit 174A provides signals to elements E5 and E6 and the second quadrature combiner unit 174B provides signals to elements E7 and E8. The first and second quadrature combiner units 174A, 174B ensure the phase of signals provided to elements E5 to E8 is the average of the phase of the signals on the input carrier lines 120, 122. For example, as the power fed to element E5 decreases, the power fed to element E6 increases so that the total power fed to the elements E5, E6 remains substantially constant.

A second output signal from the second splitter unit 140B is passed through a second phase shift unit 170B forming part of the third distribution network 151N3. The second phase shift unit 170B applies a phase shift of +45 degrees (i.e. opposite polarity to phase shift unit 170A) to a splitter unit 118B. The splitter unit 118B forms part of a splitter arrangement 118A, 118B, 118C, of the kind shown in FIG. 4, and provides output signals to the phase adjustment means 150E9–150E12 respectively of the elements E9 to E12 of the lower sub-array 100C.

Figure 8:
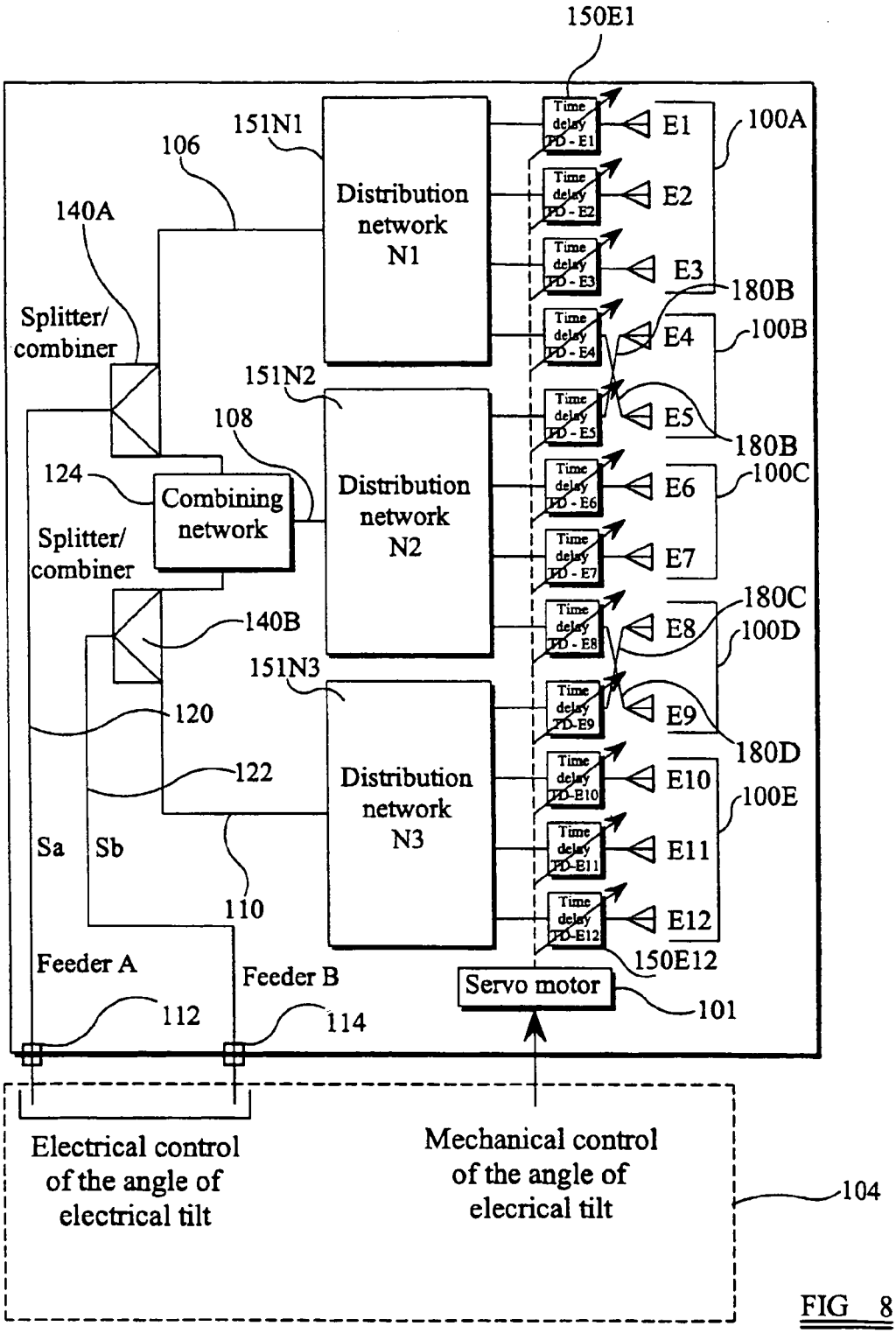
FIG. 8 shows a schematic block diagram of a quintuple sub-array antenna system of a further alternative embodiment.

FIG. 8 is an alternative embodiment of the invention, in which the antenna assembly includes five sub-arrays 100A–100E (i.e. a quintuple sub-array assembly), wherein the third and fourth sub-arrays 100B, 100D are obtained by spatially overlapping elements of a three sub-array assembly, such as that shown in FIG. 6, similar parts to those shown in FIG. 6 being indicated with like reference numerals. The input carrier lines 120, 122 supply signals Sa, Sb respectively to first and second primary splitter units 140A, 140B respectively. The first splitter unit 140A provides a first output signal to a first distribution network 151N1 along output carrier line 106 and a second output signal to a combiner unit 124. The second splitter unit 140B provides a first output signal to a third distribution network 151N3 along output carrier line 110, and a second output signal to a combiner unit 124. The combiner unit 124 provides an output signal along output carrier line 108 to the second distribution network 151N2.

Each distribution network 151N1, 151N2, 151N3 provides four output signals, each one of which is provided, through an associated phase adjustment arrangement 150E1–150E12, to an element of the array. One of the output signals 180A from the first distribution network 151N1 is spatially overlapped with one of the output signals 180B from the second distribution network 151N2 by combining the signals in air, to provide the signals to the elements, E4 and E5, of the sub-array 100B. Similarly, one of the output signals 180C from the second distribution network 151N2 is spatially overlapped with one of the output signals 180D from the third distribution network 151N3 by combining in air, to provide the signals to the elements, E8 and E9, of the sub-array 100D. The configuration in FIG. 8 provides a further improvement in phase linearity across the elements E1–E12, and further improves boresight gain and side-lobe suppression when the assembly is tilted electrically.

In practice, the distribution network 151N1 in FIG. 8 may include the splitter arrangement 116A, 116B, 116C and the phase shit unit 170A of the FIG. 7 embodiment, and the third distribution network 151N3 may include the splitter arrangement 118A, 118B, 118C and the phase shit unit 170B of the FIG. 7 embodiment. The combiner unit 24 and the second distribution network 151N2 may include the first and second splitter units 172A, 172B and the first and second quadrature combiner units 174A, 174B, as described previously with reference to FIG. 7.

Figure 10:
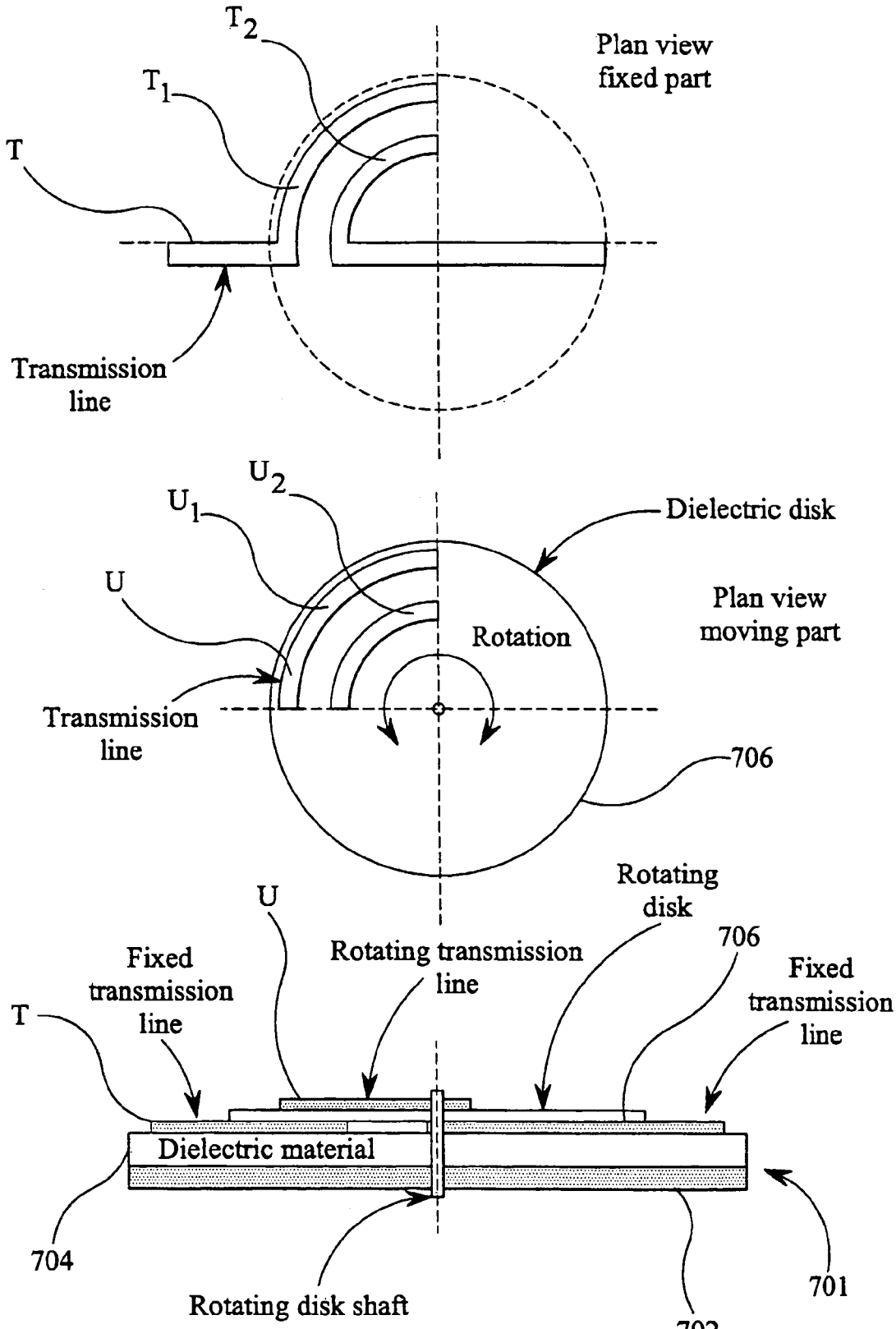
FIG. 10 illustrates an alternative mechanical phase adjustment arrangement to that shown in FIG. 9.

FIGS. 9 and 10 illustrate known apparatus for the mechanical adjustment of the phase of the signal fed to each element in the antenna assembly. Either or both of these methods may be used in the antenna assemblies of FIGS. 3 to 8 as the phase adjustment arrangements 150E1–150En (where n=number of elements in the antenna assembly).

In FIG. 9, mechanical adjustment of the phase of a signal on a transmission line is achieved by linear movement of an element of dielectric material beneath the transmission line. The mechanical adjustment arrangement 601 includes a base plate 602, across which the transmission line T to the antenna element runs, and a generally planar plate of dielectric material 604 disposed between the base plate 602 and the transmission line T. The plate of dielectric material 604, commonly termed a "wedge", is generally rectangular with a triangular or V-shaped segment 606 cut away from one longitudinal edge thereof. The wedge 604 is movable relative to the base plate 602 and the transmission line T in a direction, shown by arrow A, generally transverse to the transmission line T. Owing to its shape, linear movement of the wedge 604 causes a greater or lesser amount of dielectric material to be interposed between the transmission line and the base plate 602, thereby causing the propagation velocity and, hence, the phase of any signal on the transmission line T to be shifted by an amount dependent on the linear position of the wedge. Such linear movement is usually effected by a linear actuator in the form of a servo or other motion transducer.

The amount of phase shift applied to the signal on the transmission line T is set by the position of the wedge 604 beneath the transmission line T and the "wedge angle", the internal angle of the V-shape cut into the wedge.

FIG. 10 shows a mechanical phase adjustment arrangement, referred to generally as 701, which is operable to shift the transmission time delay, and hence the phase, of a signal on a transmission line by means of the rotary movement of a movable length of transmission line capacitively coupled to a fixed line length. The arrangement 701 includes a base plate 702 on top of which is a layer of dielectric material 704. A fixed length of transmission line T forms a transmission line with the base plate 702 and the dielectric layer 704. The transmission line is discontinuous to form two portions of transmission line T1, T2, the first portion T1 extending across the dielectric layer 704 to form a circumferential quadrant of a circle having radius R and the second portion T2 extending across the dielectric layer 704 to form a circumferential quadrant of a circle having radius, r.

A planar disc of dielectric material 706 is disposed over the transmission line T and is rotatable relative thereto about an axis coaxial with the centre of the circle defined by the first and second portions of the transmission line T1, T2. The dielectric disc 706 carries a U-shaped length of transmission line U having a first arm, U1, defining a circumferential quadrant of a circle having radius R and a second arm, U2, defining a circumferential quadrant of a circle having radius r.

The transmission lines T, U are coupled together via the dielectric disc 706 and phase adjustment of a signal on the transmission line T can be effected by rotating the dielectric disc 706 to adjust the position of the transmission line U relative to the transmission line T. As the disc is rotated through 90°, the coupling between the two transmission lines, and thereby the effective length of the transmission line to the antenna element, varies to shift the phase of a signal carried by the transmission line.

Although not shown in FIG. 10, it is possible to use the apparatus of FIG. 10 to control the phase of more than one antenna element. For example, for such a device to control the phase of signals on two separate transmission lines, a second arrangement of transmission lines T, U could be arranged on the opposite quadrant of the dielectric disc 706. The phase shift applied to each antenna element, or each sub group of elements, can be set either by the radius of the transmission line T, U on each disc, the mechanical coupling between the transmission lines or by both means.

Figure 11:
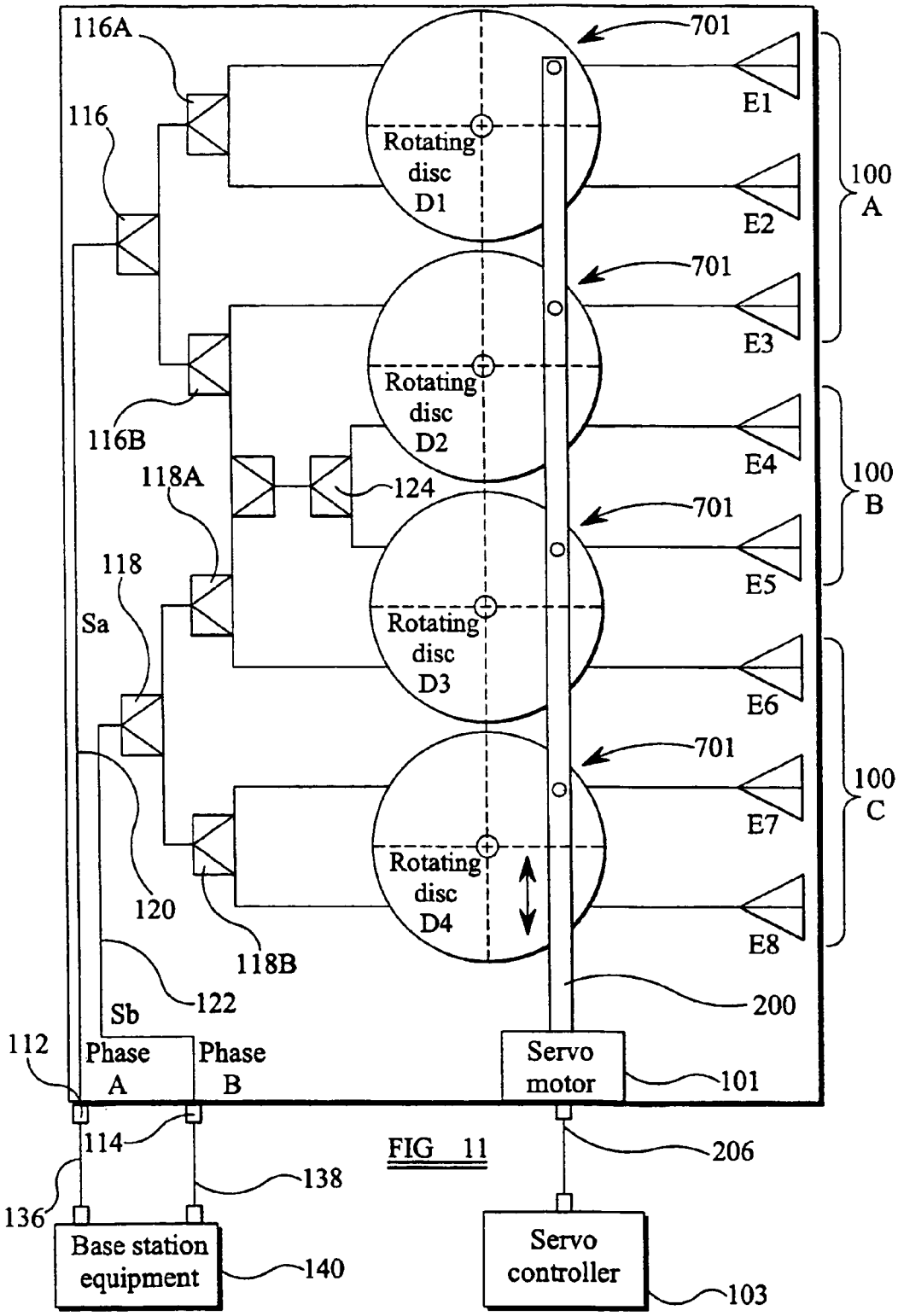
FIG. 11 is a further alternative embodiment of a triple sub-array antenna system, to show details of the mechanical phase adjustment arrangement in FIG. 10.

FIG. 11 illustrates an alternative embodiment of the invention, in which the arrangement of splitter units is a so-called "family tree" configuration, which allows signals of equal strength to be supplied to each of the elements in the assembly. Such a configuration is appropriate where the phase adjustment of individual antenna elements is present, since a cosine squared voltage distribution is not necessary to maximise boresight gain.

In this particular embodiment, the antenna assembly consists of eight elements E1 to E8; upper sub-array 101A comprising elements E1–E3, centre sub-array 100B comprising elements E4 and E5 and lower sub-array 100C comprising elements E6 to E8 (i.e. a triple sub-array system). Remote adjustment of the angle of electrical tilt of the antenna assembly is achieved by means of servo control of the mechanical phase adjustment apparatus, in combination with differential phase shift applied by electrical means to the signals supplied to the antenna elements.

The base-station control unit 104, comprising the input splitter/combiner unit 125, the RF port 126 and the first and second phase adjusters 132, 134 (none of which are shown), supplies the first and second phase shifted signals Sa, Sb to the input ports 112, 114 via the first and second feeder lines 136, 138 respectively. The input ports 112, 114 apply the signals to the input carrier lines 120, 122 respectively. The phase shifted signals Sa and Sb, on the input carrier lines 120, 122, are supplied to the first and second primary splitter units 116, 118 respectively. The splitter units are arranged such that each output of the first and second primary splitter units 116, 118 is connected to the input of a respective splitter unit in a second row of splitter units 116A, 116B, 118A, 118B.

The two outputs of the splitter unit 116A are connected to the antenna elements E1 and E2 respectively via a first phase adjustment arrangement D1 similar to that shown in FIG. 10. The first output of the splitter unit 116B is connected to the antenna element E3 via a second phase adjustment arrangement D2. The second output of the splitter unit 116B is connected to a first input of the combiner unit 124, as is the first output of the splitter unit 118A. The combiner unit 124 has two outputs, each of which is connected to the elements E4 and E5 via the second and third phase adjustment arrangements D2, D3, respectively. The second output of the splitter unit 118A is connected to the element E6 via the third phase adjustment arrangement D3 while both outputs of the splitter unit 118B are connected to the elements E7, E8 respectively via a fourth phase adjustment arrangement D4.

In FIG. 11, rotation of the discs in the phase adjustment arrangements D1 to D4 is achieved by linear movement of an actuating arm 200 pivotally and eccentrically mounted to each of the rotating discs 706 of the mechanical phase adjustment arrangements 701. Linear movement of the actuating arm 200 may be achieved, for example, by the servo motor 101 which is controlled by means of the servo controller 103. The control cable 206 can be of any desired length, enabling the servo motor 103 to be controlled from a location remote from the antenna assembly 100. The phase adjustment arrangements D1 to D4 may be configured such that movement of the respective discs through the single control point results in a substantially equal degree of rotation for each disc. However, different amounts of phase shift may be applied to the signals to each antenna element depending on the coupling between the transmission lines T, U in each of the phase adjustment mechanisms.

Figure 12:
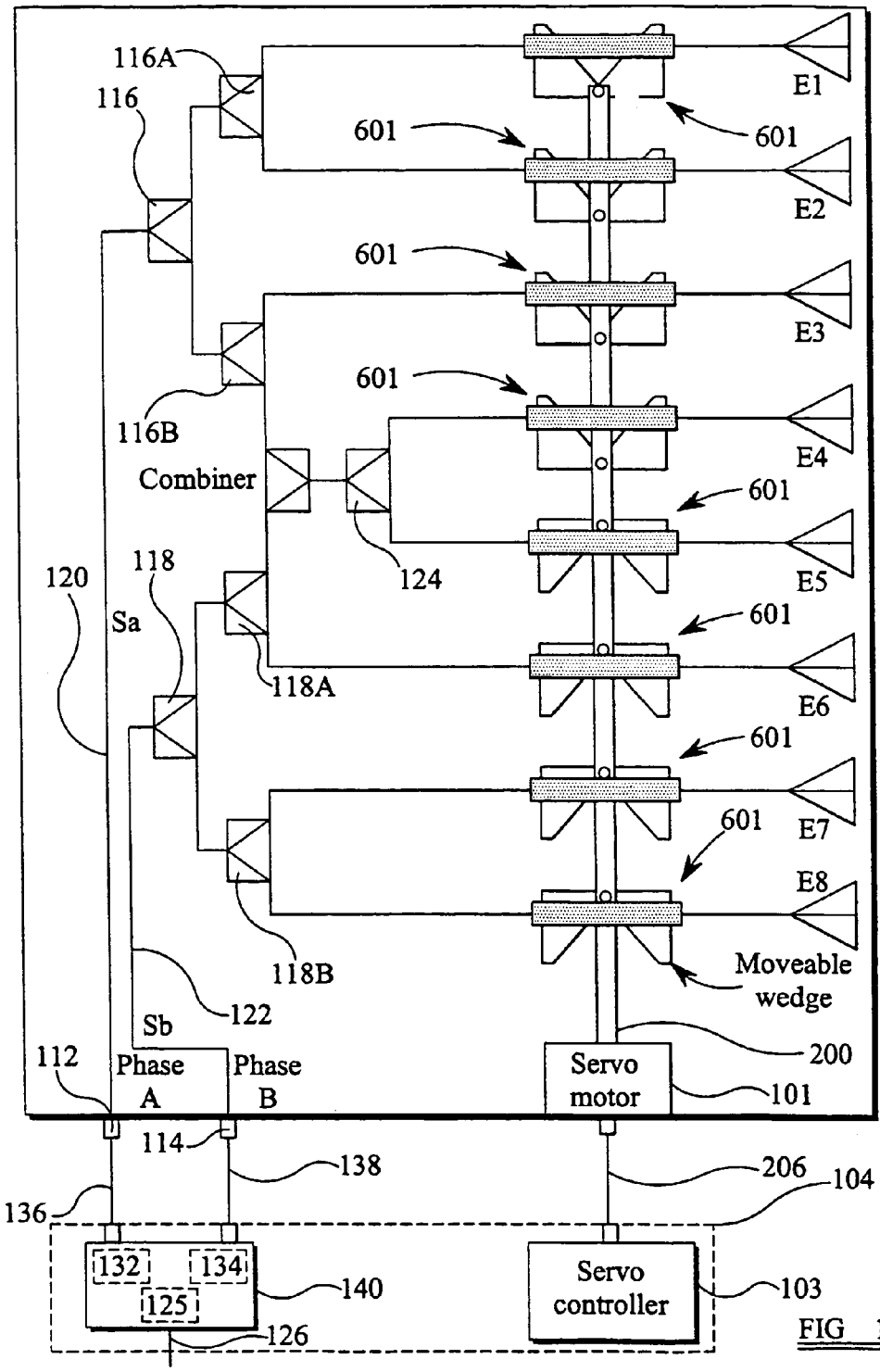
FIG. 12 is a further alternative embodiment of a triple sub-array antenna system, to show details of the mechanical phase adjustment arrangement in FIG. 9.

FIG. 12 illustrates a triple sub-array embodiment of the antenna system in which the mechanical phase adjustment arrangement 601 connected to each antenna element E1 to E8 is a mechanism similar to that shown in FIG. 9, and in which an increased number of mechanical adjustment arrangements are required to implement individual mechanical tilt to each element E1 to E8. In other words, the FIG. 12 embodiment differs from that in FIG. 11 in that there is an independent and separate moveable dielectric element associated with each element E1 to E8. A servo motor 101 and a servo controller 103 are provided, as described previously, and, again, remote adjustment of the angle of electrical tilt of the antenna assembly 100 is achieved by means of servo control of the mechanical phase adjustment arrangements 601 through the control cable 206, in combination with differential phase shift applied to the signals Sa, Sb, supplied to the antenna elements E1 to E8.

The phase of signals supplied to each element E1 to E8 is controlled by the linear movement of the dielectric wedge in each mechanism, each of which is connected to an actuating arm 200. It will be noted that the phase adjustment arrangements connected to the lower four elements E5–E8 are reversed compared to those connected to the upper four elements E1 to E4. Consequently, an increase in delay (a negative phase shift) applied to the signals supplied to the elements E1 to E4 will cause a decrease in delay (a positive phase shift) to be applied to the signals supplied to the elements E5 to E8.

In order to retain maximum boresight gain and control of the side lobe levels when the angle of electrical tilt of the antenna assembly is changed, each antenna element may require a different amount of delay for a given movement of the actuating arm 200. In the linear mechanical phase adjustment arrangement, this may be achieved by changing the angle of the V-shaped segment 606 of the wedge 604 (as shown in FIG. 9).

It will be appreciated that the rotary mechanical phase adjustment arrangement of FIG. 10 may be used in place of the linear mechanical phase adjustment arrangements 600 in FIG. 12. Using the rotary mechanical phase adjustment arrangements of FIG. 10, a different amount of delay for a given movement of the actuating arm 200 may be achieved by using a different radius for the transmission line mounted on each rotatable disc.

Although the arrangement of the splitter units 116A–116C, 118A–118C and combiner unit 124 in FIG. 12 is different from that described previously, it will be apparent from the foregoing description how this arrangement distributes the signal strength across the elements E1 to E8.

Figure 13:
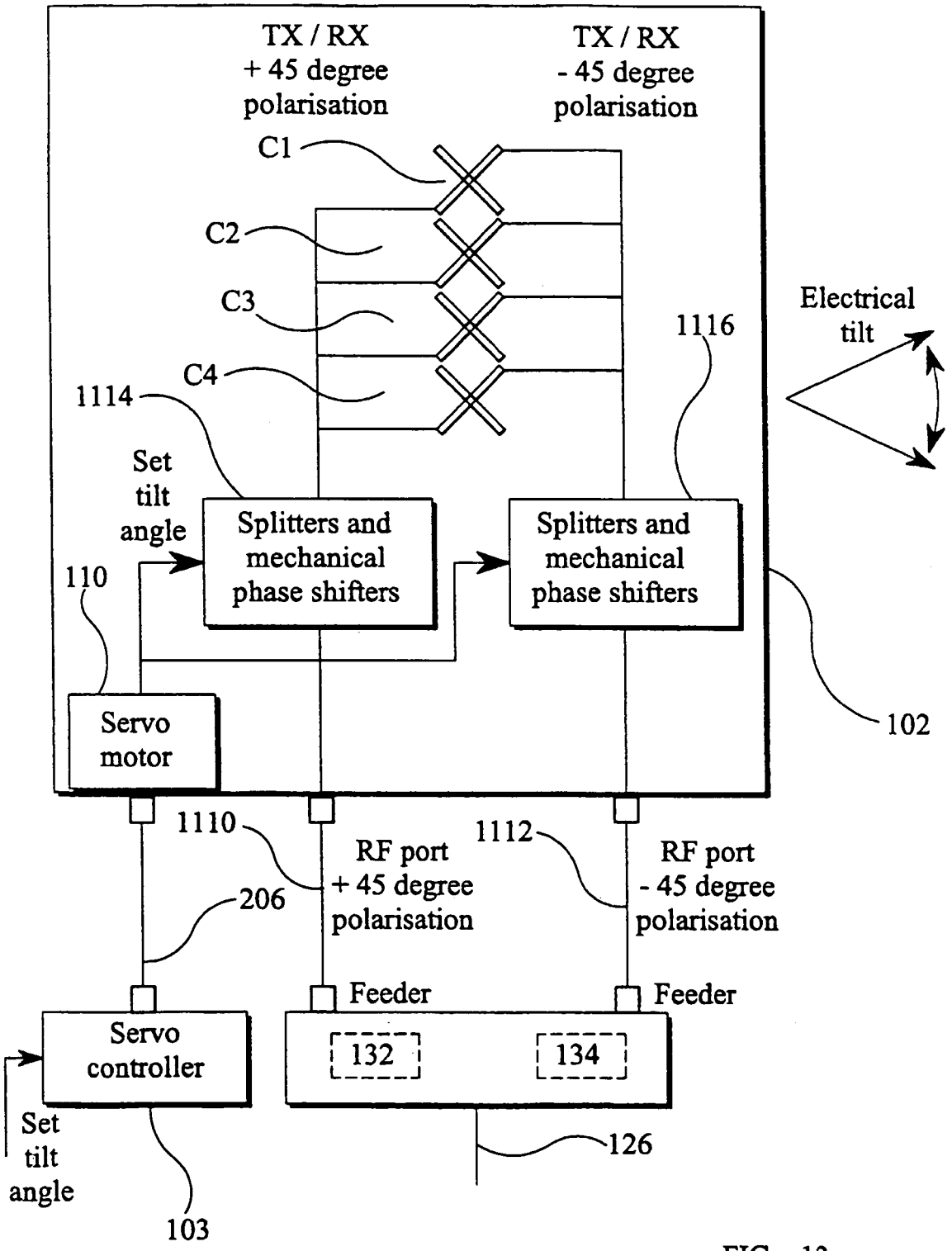
FIG. 13 is a schematic block diagram of an alternative form of system according to the invention, incorporating a dual polarity antenna assembly.

FIG. 13 shows yet a further embodiment and illustrates how the system of the present invention can be used with a dual-polarity antenna assembly. The use of dual polarity antenna assembly is well known and common in telecommunication systems. In this embodiment, the antenna assembly includes a stack of four crossed dipole elements C1 to C4, arranged in a first array of four elements angled at +45° to the vertical and a second array of four elements angled at −45° to the vertical. The first and second arrays are effectively electrically separate with individual RF feeders 1110, 1112 being supplied to each array. The first and second arrays share the common feature that the mechanical phase adjustment/splitter arrangements (referred to generally as 1114 and 1116) to each individual element (where present) are adjusted by means of a common servo mechanism so that both the first and second array have the same angle of electrical tilt. Once again, the servo motor 101 is controlled by a servo controller 103 which communicates with the servo motor 101 via a control cable 206.

It will be appreciated that the means by which the actuating arm 200 for the mechanical phase adjustment arrangements, 601, 701, 1114, 1116, is moved need not take the form of a servo control arrangement 101, 103, but may the form of an alternative arrangement which is operable from a location remote from the actuating arm 200.

It will also be appreciated that the present invention provides an effective way of remotely adjusting the electrical tilt of a phased array antenna. For example, it is possible to control and/or adjust the electrical tilt from a base station located at the base of the antenna mast upon which the antenna elements are mounted or from a location several miles from the antenna mast, as there is no requirement for manual adjustment of the antenna elements themselves. Moreover, the invention allows the independent phase shifting of signals to individual sub-arrays within the antenna assembly and automatic differential phase adjustment of signals to the centre sub-array to permit the use of only two RF inputs. Furthermore, signals to the upper and lower sub-array can be phase shifted by varying degrees which are not necessarily equal in magnitude. The vector summing of the signals supplied to the outer sub-arrays by the combiner unit 124 allows the signals supplied to the centre sub-array always to be shifted to the median value thereof, if required.

The combined mechanical and electrical control of the electrical tilt of the antenna system allows an optimum beam pattern for the antenna system to be generated with maximum boresight gain and lower side lobe levels and, moreover, such control is achievable from a location remote from the antenna assembly, for example several kilometers from the base of the antenna mast. The performance of such an antenna system is substantially improved compared with existing systems.

It will be appreciated that although different embodiments of the invention are shown and described as having a different number of antenna elements (for example E1 to E8 in FIG. 5, E1 to E12 in FIG. 6), any of the embodiments may be adapted to include more or less antenna elements, subgrouped into an appropriate arrangement of more or less sub-arrays than those shown, in a manner which would be readily apparent to a skilled person from the description hereinbefore, whilst still maintaining the aforementioned advantages.

Although the servo control mechanism 103 for the additional mechanical phase adjustment arrangements 150E1–150En is shown as forming part of the control unit 104, this need not be the case. The servo controller 103 may also be located remotely from the antenna assembly 100, as is the control unit 104, but it need not be located in the same place.

Throughout the specification, a reference to "electrical tilt" shall be taken to mean adjustment of the radiation pattern transmitted and/or received from the antenna assembly without physically moving the antenna radome, or the antenna elements, but instead implemented by adjusting the phase of signals supplied to one or more of the antenna elements. It will be appreciated, however, that electrical tilt may be adjusted by an arrangement having both mechanical and electrical adjustment elements, as shown for example in FIG. 11.

The invention claimed is:

1. An antenna system comprising:

a) an antenna assembly having an angle of electrical tilt and a plurality of antenna elements mounted upon an antenna carrier and arranged in first, second and third sub-arrays, each sub-array including at least one antenna element;

b) control means arranged to control electrically the phase of signals supplied to at least one of said sub-arrays from a location remote from said antenna assembly, wherein said control means includes:

i) phase adjustment means for connection through first and second input feeds to respective ones of said sub-arrays, thereby to adjust the phase of signals supplied thereto;

ii) first control means for controlling the phase of signals supplied to said first sub-array;

iii) third control means for controlling the phase of signals supplied to said third sub-array; and iv) second control means for automatically controlling the phase of signals supplied to said second sub-array in dependence on a predetermined function of the phase of the signals supplied to said first and third sub-arrays, said second control means including a combiner unit for receiving a first input signal having the phase of the signals supplied to said first sub-array and a second input signal having the phase of signals supplied to said third sub-array, and for providing an output signal to the second sub-array in dependence on the predetermined function of the phase of the signals supplied to said first and third sub-arrays; and c) an additional mechanical phase adjustment arrangement for further adjusting the phase of signals supplied to each antenna element.

2. An antenna system comprising:

a) an antenna assembly having an angle of electrical tilt and a plurality of antenna elements mounted upon an antenna carrier and arranged in first, second and third sub-arrays, each sub-array including at least one antenna element;

b) control means arranged to control electrically the phase of signals supplied to at least one of said sub-arrays from a location remote from said antenna assembly, wherein said control means includes:

i) phase adjustment means for connection through first and second input feeds to respective ones of said sub-arrays, thereby to adjust the phase of signals supplied thereto;

ii) first control means for controlling the phase of signals supplied to said first sub-array;

iii) third control means for controlling the phase of signals supplied to said third sub-array; and iv) second control means for automatically controlling the phase of signals supplied to said second sub-array in dependence on a predetermined function of the phase of the signals supplied to said first and third sub-arrays, said predetermined function being a vector sum of phases of signals supplied to said first and third sub-arrays; and c) an additional mechanical phase adjustment arrangement for further adjusting the phase of signals supplied to each antenna element.

3. An antenna system comprising:

a) an antenna assembly having an angle of electrical tilt and a plurality of antenna elements mounted upon an antenna carrier and arranged in first, second and third sub-arrays, each sub-array including at least one antenna element;

b) control means arranged to control electrically the phase of signals supplied to at least one of said sub-arrays from a location remote from said antenna assembly, wherein said control means includes:

i) phase adjustment means for connection through first and second input feeds to respective ones of said sub-arrays, thereby to adjust the phase of signals supplied thereto;

ii) first control means for controlling the phase of signals supplied to said first sub-array;

iii) third control means for controlling the phase of signals supplied to said third sub-array; and iv) second control means for automatically controlling the phase of signals supplied to said second sub-array in dependence on a predetermined function of the phase of the signals supplied to said first and third sub-arrays, the second control means including at least one quadrature combiner unit for receiving a first input signal having the phase of signals supplied to the first sub-array and a second input signal having the phase of signals supplied to the third sub-array and for providing a first output signal to one element of the second sub-array and a second output signal to a different element of the second sub-array, wherein said first and second output signals are dependent upon the predetermined function of the phase of the first and second input signals; and c) an additional mechanical phase adjustment arrangement for further adjusting the phase of signals supplied to each antenna element.

4. An antenna system comprising:

a) an antenna assembly having an angle of electrical tilt and a plurality of antenna elements mounted upon an antenna carrier and arranged in first, second and third sub-arrays, each sub-array including at least one antenna element;

b) control means arranged to control electrically the phase of signals supplied to at least one of said sub-arrays from a location remote from said antenna assembly, wherein said control means includes:

i) phase adjustment means for connection through first and second input feeds to respective ones of said sub-arrays, thereby to adjust the phase of signals supplied thereto;

ii) first control means for controlling the phase of signals supplied to said first sub-array;

iii) third control means for controlling the phase of signals supplied to said third sub-array; and iv) second control means for automatically controlling the phase of signals supplied to said second sub-array in dependence on a predetermined function of the phase of the signals supplied to said first and third sub-arrays, the second control means including at least one quadrature combiner unit for receiving a first input signal having the phase of signals supplied to the first sub-array and a second input signal having the phase of signals supplied to the third sub-array and for providing a first output signal to one element of the second sub-array and a second output signal to a different element of the second sub-array, wherein said first and second output signals are dependent upon the predetermined function of the phase of the first and second input signals, and the quadrature combiner unit is for combining the first and second input signals thereto such that the phase of said output signals provided by the quadrature combiner unit is the average of the phase of said first and second input signals; and c) an additional mechanical phase adjustment arrangement for further adjusting the phase of signals supplied to each antenna element.

5. An antenna system comprising:

a) an antenna assembly having an angle of electrical tilt and a plurality of antenna elements mounted upon an antenna carrier and arranged in at least two sub-arrays, each sub-array including at least one antenna element;

b) control means arranged to control electrically the phase of signals supplied to at least one of said sub-arrays from a location remote from said antenna assembly, wherein said control means includes phase adjustment means for connection through first and second input feeds to a respective one of said sub-arrays, thereby to adjust the phase of signals supplied thereto;

c) a respective signal distribution means associated with each sub-array for splitting and distributing signals to antenna elements of that sub-array, a signal distribution means associated with a first sub-array being arranged to provide at least one output signal for spatial combining with at least one output signal from another signal distribution means associated with a second sub-array to provide first and second combined output signals to first and second antenna elements of a third sub-array; and d) an additional mechanical phase adjustment arrangement for further adjusting the phase of signals supplied to each antenna element of the antenna assembly.

6. An antenna system comprising:

a) an antenna assembly having a plurality of antenna elements arranged in at least first, second and third sub-arrays, each sub-array comprising at least one antenna element;

b) first control means for controlling the phase of signals supplied to the first sub-array;

c) second control means for automatically controlling the phase of signals supplied to the second sub-array at least partly in accordance with the phase of signals supplied to the first sub-array, the second control means being arranged for automatically controlling the phase of signals supplied to the second sub-array in accordance with the vector sum of the phases of the signals supplied to said first and third sub-arrays; and d) third control means for controlling the phase of signals supplied to the third sub-array.

7. An antenna system comprising:

a) an antenna assembly having a plurality of antenna elements arranged in at least first and second sub-arrays, each sub-array comprising at least one antenna element;

b) respective signal distribution means associated with each sub-array for splitting and distributing signals to the respective sub-array elements, each of said signal distribution means includes a splitter arrangement for splitting and distributing said signals to the elements in said associated sub-array, one of said distribution means associated with a first sub-array being arranged to combine at least one output signal with at least one output signal from another of said distribution means associated with the third sub-array to provide first and second combined output signals to first and second elements of the second sub-array;

c) first control means for controlling the phase of signals supplied to the first sub-array; and d) second control means for automatically controlling the phase of signals supplied to the second sub-array at least partly in accordance with the phase of signals supplied to the first sub-array.

8. An antenna system comprising:

a) an antenna assembly having a plurality of antenna elements arranged in at least first and second sub-arrays, each sub-array comprising at least one antenna element;

b) first control means for controlling the phase of signals supplied to the first sub-array;

c) second control means for automatically controlling the phase of signals supplied to the second sub-array at least partly in accordance with the phase of signals supplied to the first sub-array; and d) at least one quadrature combiner unit for receiving a first input signal having the phase of signals supplied to the first sub-array and a second input signal having the phase of signals supplied to the third sub-array, and for providing a first output signal to one element of the second sub-array and a second output signal to a different element of the second sub-array, wherein the first output signal and the second output signal are dependent upon the predetermined function of the phase of the first and second input signals.

9. An antenna system comprising:

a) an antenna assembly having a plurality of antenna elements arranged in at least first and second sub-arrays, each sub-array comprising at least one antenna element;

b) first control means for controlling the phase of signals supplied to the first sub-array;

c) second control means for automatically controlling the phase of signals supplied to the second sub-array at least partly in accordance with the phase of signals supplied to the first sub-array; and d) at least one quadrature combiner unit for receiving a first input signal having the phase of signals supplied to the first sub-array and a second input signal having the phase of signals supplied to the third sub-array, and for providing a first output signal to one element of the second sub-array and a second output signal to a different element of the second sub-array, wherein the phase of the first output signal and the second output signal is the average of the phases of said first and second input signals.

10. An antenna system comprising:

a) an antenna assembly having an angle of electrical tilt, a plurality of antenna elements, two antenna assembly ports, signal routeing circuitry for routeing antenna element signals between the antenna assembly ports and the antenna elements, and a respective signal feeder for relaying signals between each antenna assembly port and an antenna tilt controller at a location remote from the antenna assembly; and b) variable phase shifting apparatus incorporated in the antenna tilt controller for providing electrical control of a phase difference between antenna element signals passing via different signal feeders and antenna assembly ports in order to control the angle of electrical tilt of the antenna assembly in response to such phase difference.

11. An antenna system as claimed in claim 10 including mechanical phase adjustment means for further adjusting antenna element signal phase, and wherein the antenna tilt controller is located at a base of an antenna carrier supporting the antenna assembly.

12. An antenna system as claimed in claim 11 wherein the antenna tilt controller includes first and second phase adjustment means, a single port for receiving a single input signal to the system and means for splitting the input signal into first and second signals to be supplied to the first and second phase adjustment means respectively.

13. An antenna system as claimed in claim 10 wherein the antenna assembly is arranged in at least two sub-arrays each having one or more antenna elements, and wherein the antenna tilt controller incorporates first and second phase adjustment means for adjusting the phases of signals supplied to the sub-arrays and connected to respective sub-arrays via respective signal feeders and antenna assembly ports.

14. An antenna system as claimed in claim 10 arranged in at least first and second sub-arrays each having one or more antenna elements wherein the antenna tilt controller has:

a) first control apparatus for controlling or adjusting the phase of signals supplied to the first sub-array by a first amount; and b) second control apparatus for controlling or adjusting the phase of signals supplied to the second sub-array by a second amount;

and wherein at least one of the magnitude and polarity of the second amount is different to that of the first amount.

15. An antenna system as claimed in claim 10 wherein the antenna assembly is arranged in at least two sub-arrays each having one or more antenna elements, and wherein the signal routeing means comprises a respective signal distribution apparatus associated with each sub-array for splitting and distributing signals to that sub-array's antenna elements from a respective signal feeder and antenna assembly port.

16. An antenna system as claimed in claim 15 wherein the signal distribution means include respective splitter arrangements for distributing signal strength to the sub-arrays substantially uniformly.

17. An antenna system as claimed in claim 11, wherein the mechanical phase adjustment means incorporates an array of dielectric elements each of which is moveable to change a respective signal's propagation velocity to a respective antenna element.

18. An antenna system as claimed in claim 17, wherein each antenna element has an associated input transmission line and each dielectric element is arranged for linear movement relative to its associated transmission line to shift the phase of signals supplied to it through that transmission line.

19. An antenna system as claimed in claim 17, wherein each antenna element has an associated input transmission line and each dielectric element is arranged for rotary movement relative to its associated transmission line to shift the phase of signals supplied to it through that transmission line.

20. An antenna system comprising:

a) an antenna assembly having an angle of electrical tilt, a plurality of antenna elements arranged in first, second and third sub-arrays, two antenna assembly ports, signal routeing circuitry for routeing signals between the antenna assembly ports and the antenna elements, and a respective signal feeder for relaying signals between each antenna assembly port and an antenna tilt controller at a location remote from the antenna assembly;

b) the antenna tilt controller having:

i) first control apparatus for controlling the phase of signals supplied to the first sub-array;

ii) third control apparatus for controlling the phase of signals supplied to the third sub-array; and iii) second control apparatus for automatically controlling the phase of signals supplied to the second sub-array to be a predetermined function of the phase of signals supplied to the first and third sub-arrays; and c) variable phase shifting apparatus incorporated in the antenna tilt controller and arranged to provide electrical control of a phase difference between signals passing via different signal feeders and antenna assembly ports in order to control the angle of electrical tilt of the antenna assembly.

21. An antenna system as claimed in claim 20, wherein the second control apparatus includes a combiner unit for receiving a first input signal having the phase of signals supplied to the first sub-array and a second input signal having the phase of signals supplied to the third sub-array, and for providing to the second sub-array an output signal with phase determined according to the predetermined function.

22. An antenna system as claimed in claim 20 wherein the predetermined function is the vector sum of the phases of the signals supplied to the first and third sub-arrays.

23. An antenna system as claimed in claim 20 wherein the second control apparatus includes at least one quadrature combiner unit for receiving a first input signal having the phase of signals supplied to the first sub-array and a second input signal having the phase of signals supplied to the third sub-array and for providing a first output signal to one element of the second sub-array and a second output signal to a different element of the second sub-array such that the first and second output signals are dependent upon the predetermined function of the phase of the first and second input signals.

24. An antenna system as claimed in claim 23, wherein the quadrature combiner unit is for combining the first and second input signals such that the phase of the output signals provided by the quadrature combiner unit is the average of the phase of the first and second input signals.

25. An antenna system comprising:

a) an antenna assembly having an angle of electrical tilt, a plurality of antenna elements arranged in first, second and third sub-arrays each having one or more antenna elements, two antenna assembly ports, signal routeing circuitry for routeing signals between the antenna assembly ports and the antenna elements, the signal routeing means comprising a respective signal distribution apparatus associated with each sub-array for splitting and distributing signals to that sub-array's antenna elements and a respective signal feeder for relaying signals between each antenna assembly port and an antenna tilt controller at a location remote from the antenna assembly, wherein at least one output signal from one signal distribution apparatus associated with the first sub-array is spatially combined with at least one output signal from another signal distribution apparatus associated with the second sub-array to provide first and second combined output signals to first and second elements of the third sub-array; and b) variable phase shifting apparatus incorporated in the antenna tilt controller and arranged to provide electrical control of a phase difference between signals passing via different signal feeders and antenna assembly ports in order to control the angle of electrical tilt of the antenna assembly.

26. An antenna system comprising:

a) an antenna assembly having an angle of electrical tilt, a plurality of antenna elements, two antenna assembly ports, a respective signal feeder for relaying signals between each antenna assembly port and an antenna tilt controller at a location remote from the antenna assembly, and signal routeing circuitry for routeing antenna element signals between the antenna assembly ports and the antenna elements such that each signal feeder and its respective port are for relaying signals between the remote antenna tilt controller and multiple antenna elements at least some of which are not associated with signal relay via the other feeder; and b) variable phase shifting apparatus incorporated in the remote antenna tilt controller and for providing electrical control of a phase difference between antenna element signals passing via different signal feeders and antenna assembly ports in order to control the angle of electrical tilt of the antenna assembly in response to such phase difference.

27. An antenna system as claimed in claim 26 including mechanical phase adjustment means for further adjusting antenna element signal phase, and wherein the antenna tilt controller is located at a base of an antenna carrier supporting the antenna assembly.

28. An antenna system as claimed in claim 27 wherein the antenna tilt controller includes first and second phase adjustment means, a single port for receiving a single input signal to the system and means for splitting the input signal into first and second signals for supply to the first and second phase adjustment means respectively.

29. An antenna system as claimed in claim 26 wherein the antenna assembly is arranged in at least two sub-arrays each having one or more antenna elements, and wherein the antenna tilt controller incorporates first and second phase adjustment means for adjusting the phases of signals supplied to the sub-arrays and connected to respective sub-arrays via respective signal feeders and antenna assembly ports.

30. An antenna system as claimed in claim 26 having at least first and second sub-arrays each with one or more antenna elements, and further comprising means for automatically controlling the phase of signals supplied to the first sub-array in dependence on the phase of signals supplied to the second sub-array.

31. An antenna system as claimed in claim 26 arranged in at least first and second sub-arrays each having one or more antenna elements wherein the antenna tilt controller has:

a) first control apparatus for controlling or adjusting the phase of signals supplied to the first sub-array by a first amount; and b) second control apparatus for controlling or adjusting the phase of signals supplied to the second sub-array by a second amount;

and wherein at least one of the magnitude and polarity of the second amount is different to that of the first amount.

32. An antenna system as claimed in claim 26 wherein the antenna assembly is arranged in at least two sub-arrays each having one or more antenna elements, and wherein the signal routeing means comprises a respective signal distribution apparatus associated with each sub-array for splitting and distributing signals to that sub-array's antenna elements from a respective signal feeder and antenna assembly port.

33. An antenna system as claimed in claim 32 wherein the signal distribution apparatuses include respective splitter arrangements for distributing signal strength to the sub-arrays substantially uniformly.

34. An antenna system as claimed in claim 27 wherein the mechanical phase adjustment means incorporates an array of dielectric elements each of which is moveable to change a respective signal's propagation velocity to a respective antenna element.

35. An antenna system as claimed in claim 34 wherein each antenna element has an associated input transmission line and each dielectric element is arranged for linear movement relative to its associated transmission line to shift the propagation velocity and phase of a signal supplied to it through that transmission line.

36. An antenna system as claimed in claim 34 wherein each antenna element has an associated input transmission line and each dielectric element is arranged for rotary movement relative to its associated transmission line to shift the propagation velocity and phase of signals supplied to it through that transmission line.

* * * * *